US007967732B2

(12) United States Patent
D'Addario et al.

(10) Patent No.: US 7,967,732 B2
(45) Date of Patent: Jun. 28, 2011

(54) FINGER AND HAND EXERCISER WITH TENSION ADJUSTER

(75) Inventors: James D'Addario, Old Westbury, NY (US); Alexandru Maxim, Farmingdale, NY (US)

(73) Assignee: D'Addario & Company, Inc., Farmingdale, NY (US)

( * ) Notice: Subject to any disclaimer, the term of this patent is extended or adjusted under 35 U.S.C. 154(b) by 187 days.

(21) Appl. No.: 12/456,386

(22) Filed: Jun. 16, 2009

(65) Prior Publication Data

US 2009/0318269 A1 Dec. 24, 2009

Related U.S. Application Data

(60) Provisional application No. 61/132,121, filed on Jun. 16, 2008.

(51) Int. Cl.
*A63B 21/00* (2006.01)

(52) U.S. Cl. ..... 482/47; 482/44

(58) Field of Classification Search ..... 482/47, 482/49, 44; 84/465; 600/587
See application file for complete search history.

(56) References Cited

U.S. PATENT DOCUMENTS

| | | | | | |
|---|---|---|---|---|---|
| 3,216,412 | A | | 11/1965 | Houle | 128/26 |
| 3,447,415 | A | * | 6/1969 | Kime | 84/465 |
| 4,609,191 | A | | 9/1986 | Remme | 272/137 |
| 4,765,608 | A | | 8/1988 | Bonasera | 272/67 |
| 5,147,256 | A | | 9/1992 | Silagy | 482/47 |
| 5,156,581 | A | | 10/1992 | Chow | 482/47 |
| 5,425,690 | A | * | 6/1995 | Chang | 482/46 |
| 5,431,611 | A | * | 7/1995 | Silagy | 482/47 |
| 5,690,585 | A | * | 11/1997 | Ditsch | 482/47 |
| 6,036,621 | A | | 3/2000 | Hancock | 482/47 |
| 6,443,874 | B1 | | 9/2002 | Bennett | 482/44 |
| 6,673,026 | B2 | * | 1/2004 | Pozos et al. | 600/587 |
| 2003/0131710 | A1 | | 7/2003 | Goldiner | 84/265 |

* cited by examiner

*Primary Examiner* — Jerome W Donnelly
(74) *Attorney, Agent, or Firm* — Alix, Yale & Ristas, LLP

(57) ABSTRACT

A finger and hand exerciser includes a housing defining four chambers arranged side-by-side in parallel with one another. Each chamber receives a tension adjustment member, a plunger that is reciprocatingly slidable in the chamber, and a helically wound compression spring extending between the plunger and the tension adjustment member. Each tension adjustment member includes a knurled wheel which the user of the finger and hand exerciser may turn to decrease or increase the force the spring exerts on the plunger.

17 Claims, 40 Drawing Sheets

FINGER AND HAND EXERCISER WITH TENSION ADJUSTER

CROSS-REFERENCE TO RELATED APPLICATION

This application is based on U.S. Provisional Application No. 61/132,121, filed on Jun. 16, 2008, and entitled, "Finger and Hand Exerciser with Tension Adjuster", the disclosure of which is incorporated herein by reference and on which priority is hereby claimed.

BACKGROUND OF THE INVENTION

1. Field of the Invention

This invention relates to finger and hand exercisers for medical and non-medical applications.

2. Description of the Prior Art

U.S. Pat. No. 5,147,256 (Silagy) discloses a combination individual finger and entire hand exerciser. As disclosed in the Silagy '256 patent, the exerciser includes three cooperating body members, mainly an upper body member 12, a centrally disposed body member 14 and a lower body member 16. Body member 12 is provided to promote individual finger exercising and includes four adjacent, individually independently slidable finger grips 12*a*, 12*b*, 12*c* and 12*d*. The bottom body member 16 is provided to promote entire hand exercising.

Each of the finger grips 12*a*-12*d* is maintained in an initial clearance position from the centrally disposed body member 14 by a helical spring 30 which is disposed in an encircling relation about a pin 34 which is slidable in the middle body member 14. Exposed caps 18*a*-18*d* of the upper body member 12 are respectively provided on finger grips 12*a*-12*d*. A user may contact the caps 18*a*-18*d* with his fingers and press down on finger grips 12*a*-12*d* against the resistance of springs 30 to exercise his fingers.

It is noted that the tension in the exercising springs 30 forming part of the finger grips 12*a*-12*d* is not adjustable by the user, and may provide too great or too little resistance for the user's individual fingers when the user is performing exercises with the finger and hand exerciser disclosed in the Silagy '256 patent.

Another finger and hand exerciser is disclosed in U.S. Pat. No. 5,431,611 (Silagy). The Silagy '611 patent discloses an exerciser where the finger plunger components that are pressed by the user are allegedly adjustable in size to accommodate the hand width and finger length dimensions of the user.

The Silagy '611 patent discloses that the finger and hand exercising device includes four resistance spring, plunger-type, finger-actuated members 12*a*-12*d*, each of which is attached to a base 14. Each finger-actuated member includes an externally threaded, height-adjusting member 30 which is threadingly engaged with a housing 24 and in which is received an exercise spring 36. Slidably disposed in relation to height-adjusting member 30 is a tube 46 for containing spring 36. A removable cap 60 for engagement with a user's finger is removably threaded onto tube 46 to hold the exercising spring in place.

The user may raise or lower the height of the finger-actuated members 12*a*-12*d* to adjust for variations in the user's finger lengths by turning threaded member 30 in housing 24 of each of the plungers 12*a*-12*d*.

It should be noted from the Silagy '611 patent that the tension of the exercising springs 36 is not individually adjustable and remains the same even as the height of the plungers 12*a*-12*d* is adjusted. In fact, the Silagy '611 patent teaches that the cap 60 must be removed from tube 46 to replace and insert an exercise spring 36 of an appropriate construction material and helical turns or configuration to vary the exercise effort in using the device.

OBJECTS AND SUMMARY OF THE INVENTION

It is an object of the present invention to provide a finger and hand exerciser which allows the user thereof to adjust the resistance provided by the exerciser applied individually to each finger of the user.

It is another object of the present invention to provide a finger and hand exerciser which allows the user to adjust the individual spring tension in each finger plunger of the exerciser without affecting the height of the finger plungers relative to the base or housing of the exerciser on which they are mounted.

It is yet another object of the present invention to overcome the inherent disadvantages of the finger and hand exercisers disclosed in the Silagy '256 and '611 patents.

It is a further object of the present invention to provide a finger and hand exerciser which includes markings for the user of the exerciser to note the relative resistance applied to each finger.

It is yet a further object of the present invention to provide a finger and hand exerciser which is adaptable to be fitted with a mechanical or electronic metronome.

In accordance with one form of the present invention, a finger and hand exerciser includes a housing or base defining four chambers arranged side-by-side in parallel with one another. Each chamber receives a tension adjustment member in a lower portion of the chamber defined by the housing, a plunger captively received by and reciprocatingly slidable in an upper portion of each chamber defined by the housing, and a helically wound compression spring extending between the plunger and the tension adjustment member in each chamber.

Each tension adjustment member includes a knurled wheel having its outer peripheral edge at least partially exposed through a pair of cutouts formed through the thickness of the housing on opposite faces thereof. The lower portion of each tension adjustment member is threaded, and is threadingly received by threaded portions of interior side walls of the housing defining each chamber at the lower portion thereof.

The user may turn the knurled wheel of any one of the tension adjustment members to cause the adjustment member to move axially within its respective chamber toward and away from the bottom of the housing, depending upon the direction that the knurled wheel is rotated. Turning the wheel in one direction causes the tension adjustment member to rise within its respective chamber toward the plunger aligned therewith, which compresses the helical spring and increases the force the spring exerts on the plunger. Thus, a user must exert greater finger or hand pressure when forcing the plunger into the chamber to overcome the resistance of the compressed spring.

Alternatively, the user may rotate the knurled wheel of a particular tension adjustment member to cause the adjustment member to move downwardly axially in the chamber, away from the plunger, thus allowing the corresponding compression spring to expand between the plunger and the tension adjustment member. This action decreases the force which the compression spring exerts on the plunger, so that the user need exert less force on the plunger to move the plunger downwardly into its corresponding chamber to overcome the resistance of the compression spring.

Accordingly, the effort which the user requires to depress the corresponding plunger for each finger may be individually adjusted and tailored to meet the exercise requirements of the user.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
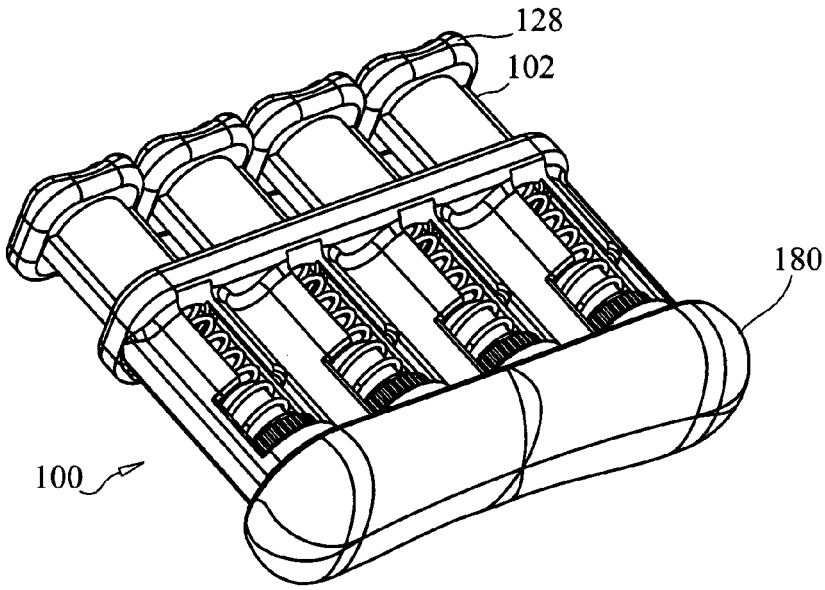
FIG. 1 is a front isometric view of a finger and hand exerciser constructed in accordance with one form of the present invention, the exerciser being shown in a low spring tension state.
Figure 2:
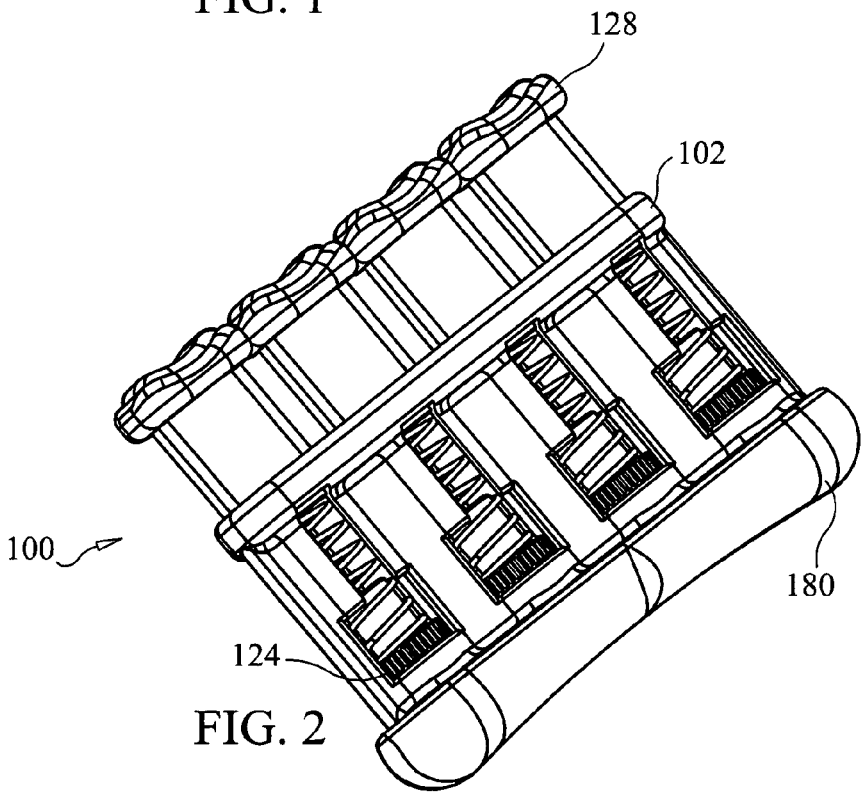
FIG. 2 is a front isometric view taken from a different perspective from that of FIG. 1 of a finger and hand exerciser constructed in accordance with one form of the present invention and again being shown in a low spring tension state.
Figure 3:
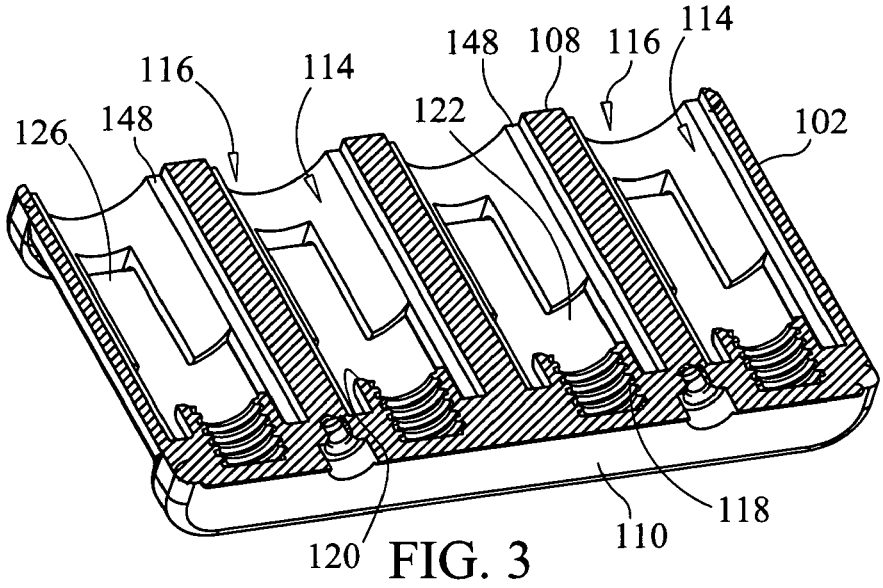
FIG. 3 is a bottom isometric view of a portion of the housing of the finger and hand exerciser of the present invention illustrated by FIG. 1 of the drawings.
Figure 4:
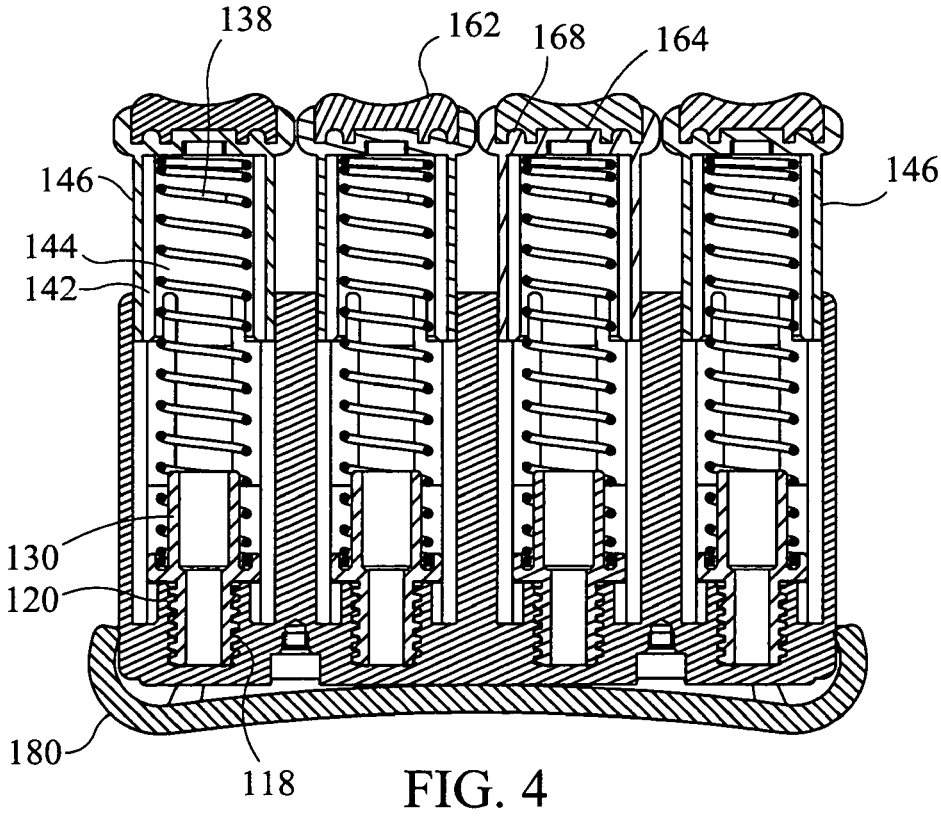
FIG. 4 is a longitudinal cross-sectional view of the finger and hand exerciser illustrated by FIG. 1 of the drawings and being shown in a low spring tension state.
Figure 5:
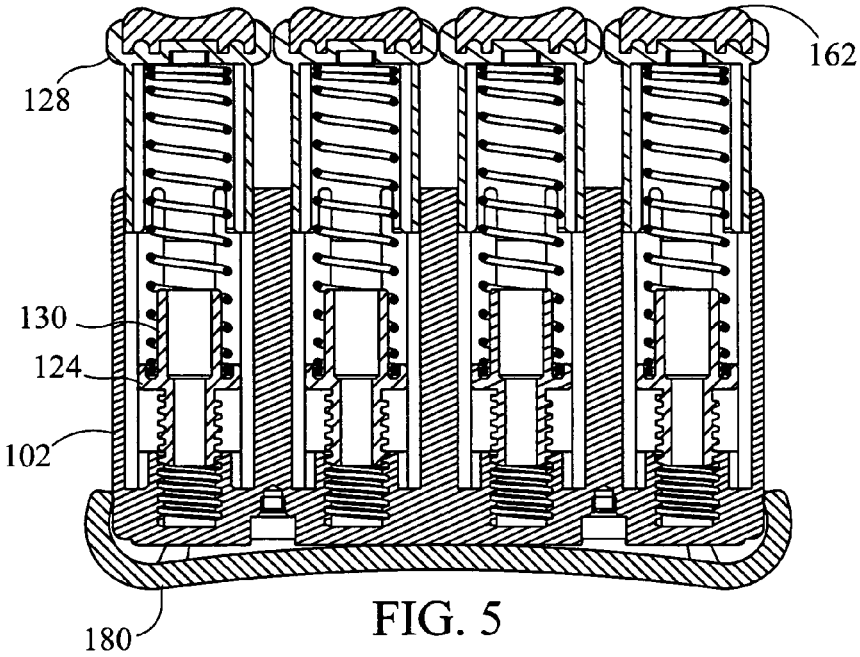
FIG. 5 is a longitudinal cross-sectional view of the finger and hand exerciser illustrated by FIG. 1 of the drawings and being shown in a high spring tension state.

Initially referring to FIGS. 1-17 of the drawings, it will be seen that a finger and hand exerciser 100 having a spring tension adjustment for each finger, formed in accordance with the present invention, includes a housing 102 having a front wall 104, a rear wall 106 situated opposite the front wall 104, a top wall 108 and a bottom wall 110 situated opposite the top wall 108. The housing 102 may be integrally formed, or may be formed from a front half and a back half which may be joined together by adhesive, fasteners or any other means well known in the art, such as shown in FIG. 3. The housing 102 is preferably shaped with four semi-cylindrical or arcuate wall protrusions 112 on its front wall 104 and opposite rear wall 106. Each wall protrusion 112 defines interiorly of the housing a chamber 114 so that, overall, the housing 102 defines interiorly preferably four chambers 114, each arranged side-by-side in parallel and extending from the bottom wall 110 of the housing to the top wall 108.

Preferably, the top wall 108 is formed with four circular openings 116, each opening 116 communicating with a respective chamber 114 formed in the housing 102.

The housing 102 defines each chamber 114 with a generally cylindrical shape that extends axially from the bottom wall 110 to the top wall 108 of the housing, each chamber 114 being aligned and communicating with a corresponding opening 116 formed in the top wall 108.

The lower portion of the housing 102 is formed with four interiorly threaded bores 118, each of which is in communication with a respective chamber 114. Each threaded bore 118 may be axially extended by including a bushing 120 which is integrally formed with the lower portion of the housing 102 and which extends into the chamber 114. The bushing 120 is similarly interiorly threaded and, as will be seen, extends the overall axial length of the bore 118 so that a greater range of spring tension adjustment may be provided with respect to each finger of the user's hand.

Each cylindrical protrusion 112 of the front wall 104 and rear wall 106 of the housing includes a cutout 122 formed through the thickness thereof, which cutout 122 communicates with a corresponding chamber 114 defined by and interiorly of the housing 102. As will be described in greater detail, the cutouts 122 define a window through which a spring tension adjustment knob or wheel 124 is at least partially exposed to the user for adjustment of the exercise force required by the user with respect to each finger of the user's hand. Slots 126 are also formed through the cylindrical portions 112 of the front wall 104 and rear wall 106 of the housing, which slots 126 extend axially along at least a portion of the length of each cylindrical wall portion 112. Again, as will be described in greater detail, the slots 126 are provided to hold captive a finger exercising plunger 128 within a corresponding chamber 114.

A spring tension adjustment member 130 is received by each chamber 114. Each tension adjustment member 130 is generally cylindrical in shape and includes an upper portion 132, a lower portion 134 which is disposed axially opposite the upper portion 132, and a middle portion 136. The upper portion 132 is cylindrical in shape and has an outer diameter which is equal to or slightly less than the inner diameter of the helically wound, compression spring 138 so that the lower portion of the compression spring 138 may be closely disposed about the outer surface of the upper portion 132 of the tension adjustment member 130. The closeness in the outer diameter of the upper portion 132 of the tension adjustment member 130 and the inner diameter of the compression spring 138 helps minimize or prevents the compression spring 138 from buckling or protruding sideways and deviating from its longitudinal axis during the spring's compression and expansion.

The lower portion 134 of each tension adjustment member 130 includes threads so that the lower portion 134 of the tension adjustment member 130 may be threadingly received by the threaded bore 118 and bushing 120 of the lower portion of the housing 102.

The middle portion 136 of each tension adjustment member 130 includes a radially outwardly extending wheel or knob 124, which wheel or knob 124 includes an outer periphery which is knurled to facilitate rotation of the wheel by the user. The wheel 124 is integrally formed on the tension adjustment member 130 so that rotation of the wheel 134 in a clockwise or counterclockwise direction will cause the tension adjustment member 130 and the threaded lower portion 134 thereof to turn with the wheel. The wheel 124 of each tension adjustment member 130 has an outer diameter which is preferably equal to or slightly less than the diameter of the circular openings 116 formed in the top wall 108 of the housing and the inner diameter of the chambers 114, and preferably has a greater diameter than those of the upper portion 132 and lower portion 134 of the tension adjustment member 130, so that each tension adjustment member 130 may be received through the corresponding circular opening 116 in the top wall 108 of the housing 102 and positioned within the corresponding chamber 114 during assembly of the finger and hand exerciser 100 of the present invention. Furthermore, the middle portion 136 of each tension adjustment member 130, and in particular the wheel 124 thereof, preferably has formed in the upper surface thereof a recess or well 140 for seating the lowermost end of the compression spring 138.

The finger and hand exerciser 100 of the present invention also includes a plurality of finger exercising plungers 128. Each plunger 128 has a generally cylindrical portion 142 that defines an internal bore 144. The inner diameter of the plunger bore 144 is slightly greater than or equal to the outer diameter of the compression spring 138 so that the upper portion of the compression spring 138 may be closely received by the bore 144 of a corresponding plunger 128. Again, the closeness in the inner diameter of the plunger bore 144 and the outer diameter of the compression spring 138 maintains the axially extending shape of the spring 138 and prevents it from bulging sideways during compression and expansion of the spring caused by movement of the plunger 128.

The outer diameter of the cylindrical portion 142 of each plunger 128 is equal to or slightly less than the diameter of the circular opening 116 formed in the top wall 108 of the housing and the diameter of the corresponding chamber 114 by which it is received to allow the plunger 128 to move reciprocatingly axially within its corresponding chamber 114 and to minimize or prevent its rocking sideways within the chamber 114 as the plunger 128 slides reciprocatingly therewithin. Preferably, each plunger 128 includes a pair of diametrically opposed ribs 146 extending longitudinally axially along at least a portion of the length of the cylindrical portion 142 thereof and radially outwardly from the outer surface of the plunger 128. The ribs 146 of each plunger 128 are received by corresponding grooves 148 formed on diametrically opposite sides of each chamber 114 by the inner surface of the cylindrical portions of the housing 102 defining the chambers 114. The cooperation of the plunger ribs 146 and the corresponding housing grooves 148 prevents each plunger 128 from rotating as it moves reciprocatingly within its corresponding chamber 114 during an exercise routine.

Each plunger 128 also preferably includes resilient tabs 150 formed on diametrically opposite sides of the lower portion of the cylindrical portion 142 of the plunger. The resilient tabs 150 are defined by axially extending cuts 152 formed through the thickness of the cylindrical portion 142 of the plunger 128 on opposite sides of each tab 150 to provide the tabs with resiliency and to allow radial movement of the tabs 150 when the plunger 128 is received by a corresponding chamber 114 formed in the housing 102 of the finger and hand exerciser 100. Extending radially outwardly from each tab 150 of each plunger 128 is a shoulder 154, which is urged radially outwardly from the cylindrical portion 142 of the plunger 128 by each resilient tab 150.

When the finger and hand exerciser 100 of the present invention is assembled, a tension adjustment member 130 is placed in a corresponding chamber 114. The wheel 124 is then turned so that the threaded lower portion 134 of the tension adjustment member is received by the threaded lower portion of the housing 102 and bushing 120 defining the bore 144 situated below the chamber 114. Then, the helically wound compression spring 138 is placed in its corresponding chamber 114, with its lowermost end resting in the well 140 defined by the wheel 124 of the tension adjustment member 130. The cylindrical portion 142 of the plunger 128 is then at least partially received by a corresponding chamber 114 through the aligned opening 116 formed in the top wall 108 of the housing 102, with the upper portion of the compression spring 138 being received by the bore 144 defined by the cylindrical portion 142 of the plunger. When placing the plunger 128 in the corresponding chamber 144, the ribs 146 on the plunger 128 are aligned with the grooves 148 formed in the interior walls of the housing 102 defining the corresponding chamber 114 to allow the plunger 128 to move reciprocatingly axially within the chamber 114, but not rotationally.

As described previously, diametrically opposed slots 126 are formed through the thickness of the front wall 104 and rear wall 106 of the housing 102 at each cylindrical portion 112 defining a corresponding chamber 114. As the plunger 128 is maneuvered into a corresponding chamber 114, the resilient tabs 150 formed on the lower end of the plunger cylindrical portion 142 are radially inwardly deflected by the interior wall surfaces of the housing 102 defining the corresponding chamber 114 and are positioned in alignment with a corresponding slot 126 formed in the front wall 104 and rear wall 106 of the housing 102. When each resilient tab 150 of the plunger 128 reaches the uppermost extent of a corresponding slot 126 during insertion of the plunger 128 into the housing 102, the shoulder 154, which is dimensioned in width to be equal to or slightly less than the width of the slot 126, is biased radially outwardly by the resiliency of the tab 150 on which it is mounted and is captively received by a corresponding slot 126 formed in the front wall 104 and rear wall 106 of the housing. The shoulder 154 of each tab 150 is retained by and moves axially within its corresponding slot 126 as the plunger 128 is reciprocatingly moved by finger pressure within its corresponding chamber 114. The cooperation of the plunger tabs 150 and housing slots 126 secures the plungers 128 to the housing 102 while allowing the plungers 128 to move reciprocatingly on the housing 102 under finger or hand pressure.

Figure 9:
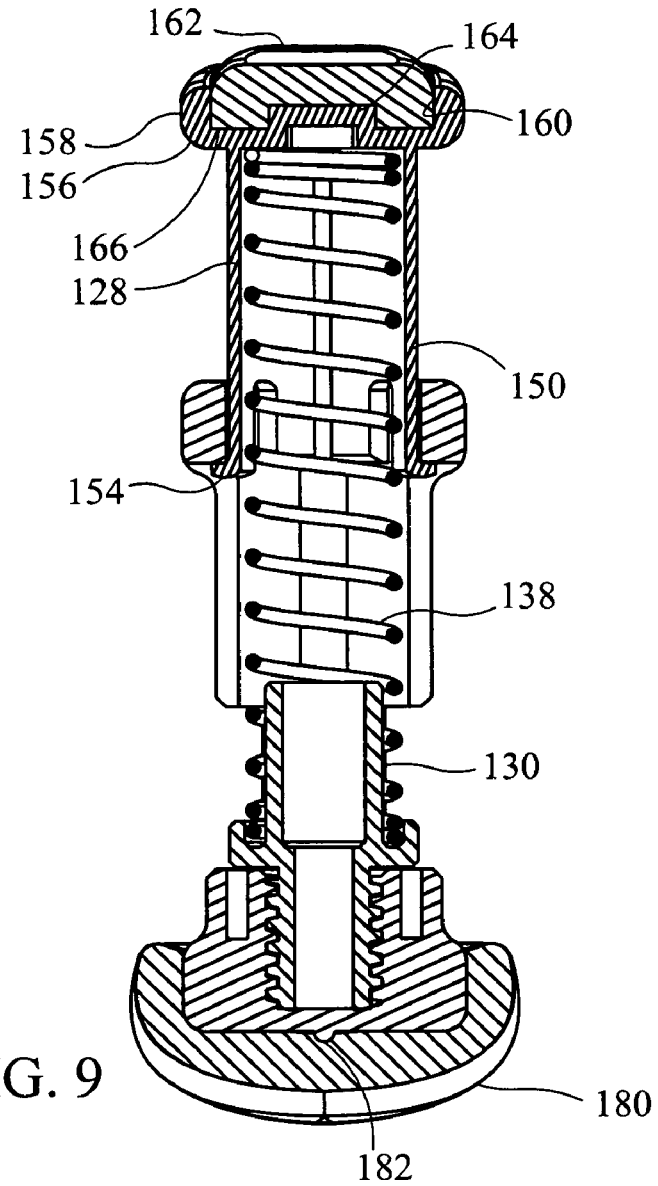
FIG. 9 is a transverse cross-sectional view of the finger and hand exerciser of the present invention illustrated by FIG. 1 of the drawings.
Figure 10:
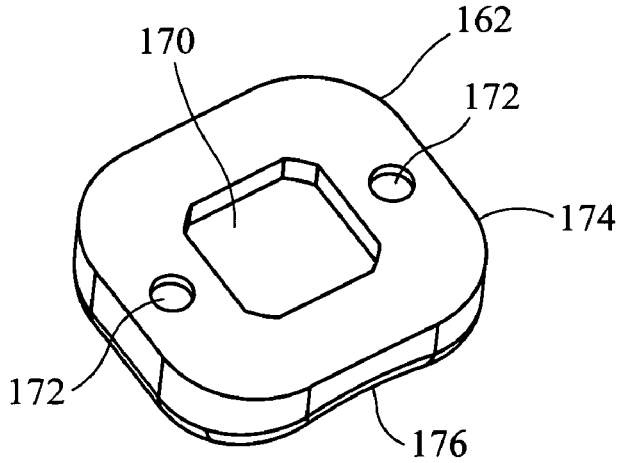
FIG. 10 is a bottom isometric view of a finger pad forming part of the finger and hand exerciser of the present invention illustrated by FIG. 1 of the drawings.

Each plunger 128 includes a rectangularly-shaped upper portion 156 which is integrally formed at the upper axial end of the cylindrical portion 142. The upper portions 156 of the plungers 128 reside outside of the housing 102 above the top wall 108 thereof. The upper portion 156 of each plunger 128 includes upstanding side walls 158 which define a well 160 for receiving a finger pad or cushion 162. The finger pad 162 may be formed from rubber or other resilient material to cushion the user's fingers when he or she is using the finger and hand exerciser 100 of the present invention and depressing each plunger 128. A rectangular central protrusion 164 extends upwardly from the lower surface 166 of the upper portion 156 of the plunger 128 into the well 160. Additionally, preferably, a pair of pins 168 formed on opposite sides of the rectangular protrusion 164 extends upwardly from the lower surface 166 of the upper portion 156 of the plunger 128 into the well 160. As shown in FIG. 9, the underside of the pad 162 includes a rectangular recess 170 and circular recesses 172 formed in the lower surface 174 of each pad 162 to respectively receive the rectangular protrusion 164 and pins 168 of a corresponding plunger 128. The pad 162 is press fitted into the well 160 defined by the side walls 158 of the upper portion 156 of the plunger 128 such that the rectangular protrusion 164 is received by the correspondingly dimensioned rectangular recess 170 of the finger pad 162, and the pins 168 are received by the correspondingly dimensioned circular recesses 172 of the finger pad 162. Thus, the pads 162 are press fitted into the wells 160 and maintained therein in a slightly compressed state, but are preferably removable for replacement, if necessary.

The upper surface 176 of each finger cushioning pad 162 is formed with a concave shape so that the user may rest his finger comfortably and securely, without slipping off the plunger 128, on the concavely-shaped upper surface 176 of the plunger pad 162.

One of the advantages of the present invention over the aforementioned Silagy patents is that the tension in the spring 138 for each finger may be adjusted by the user. As described previously, the knurled wheel 124 on each tension adjustment member 130 is exposed through the cutout 122 formed in the front wall 104 and rear wall 106 of the housing 102, and thus may be grasped and rotated in a clockwise or counterclockwise direction by the user. When the wheel 124 is turned in one direction, for example, in the clockwise direction, when the finger and hand exerciser 100 of the present invention is viewed from the top, the tension adjustment member 130 to which the wheel 124 is connected moves axially downwardly within its corresponding chamber 114 by the interaction of the threaded lower portion 134 of the tension adjustment member 130 and the threaded bore 118 in which it is received. This allows the helically wound compression spring 138 to expand, so that it provides less force on the plunger 128 and, concomitantly, less resistance to the user to press the plunger 128 downwardly into the housing 102 with his finger resting on the pad 162 of the plunger.

Alternatively, by turning the wheel 124 of the tension adjustment member 130 in the opposite direction, for example, in the counterclockwise direction, when the finger and hand exerciser 100 of the present invention is viewed from the top, the tension adjustment member 130 to which the wheel 124 is connected moves axially upwardly within its corresponding chamber 114, and compresses the spring 138 such that the spring 138 exerts greater force on the plunger 128 in which it is partially received and provides greater resistance to a user pressing down on the plunger 128 with his finger. Thus, the compression spring 138 inside each finger exercising plunger 128 may be adjusted in tension by the user to provide more or less resistance for each of the user's fingers when he presses down on the plungers 128. The pitch of the threads of the bore 118 and the lower portion 134 of the tension adjustment member 130 is chosen to allow an infinite fine adjustment in spring tension and resistance to the user when he presses down on the plungers 128.

It should be further noted that, even though the tension in each spring 138 may vary to provide different resistance for each finger, each of the finger plungers 128 remains at the same height above the top wall 108 of the housing 102 when not depressed by the user.

Figure 11:
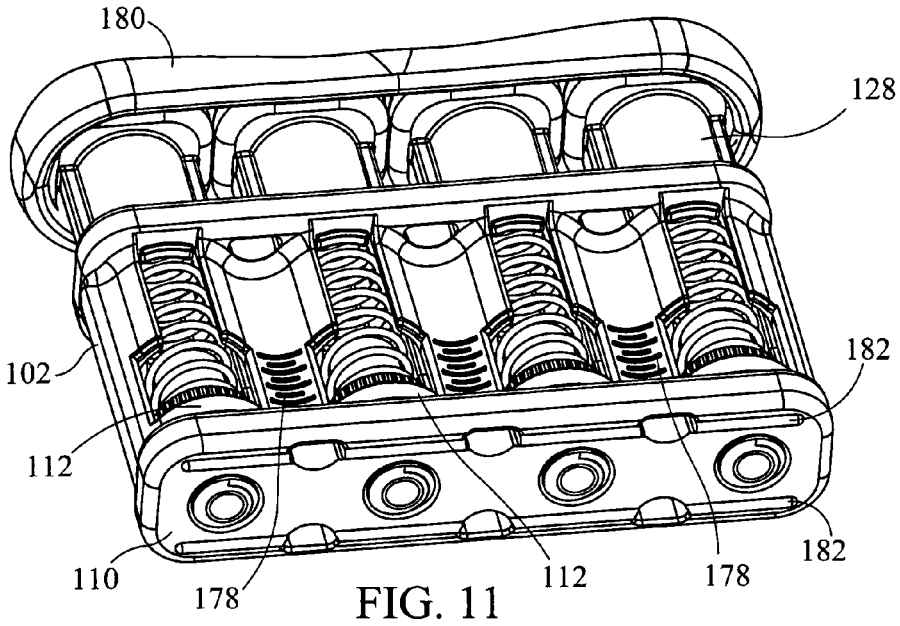
FIG. 11 is a front isometric view of a finger and hand exerciser constructed in accordance with another form of the present invention with the palm cushion removed from the bottom thereof and placed on the finger exercising plungers of the exerciser.

In a preferred form of the present invention, and as shown in FIG. 11, the front wall 104 and rear wall 106 of the housing 102 may be provided with a series of markings or gradations 178 situated axially along the cylindrically shaped portions 112 on the outer surface of the housing 102, and positioned alongside and in alignment with the cutouts 122 through which the tension adjustment wheel 124 is exposed. Thus, the user can easily see, with the aid of these gradations 178, the relative tension placed on each compression spring 138 and the resistance provided by these springs to the user when depressing the plungers 128 with his fingers. When a wheel 124 of a corresponding tension adjustment member 130 is situated at the lower end of the wheel cutout 122, and in alignment with the lowermost gradation or marking 178, the user knows that the compression spring 138 is in its most expanded state and provides the least resistance when the user depresses the corresponding plunger 128 with his finger. When the wheel 124 for adjusting tension in the spring 138 is situated at the upper end of the cutout 122, and in alignment with the uppermost gradation or marking 178, the user knows that the spring 138 is in its most compressed state and provides greater resistance to the user when depressing the corresponding plunger 128 against the force of the spring 138. The gradations or markings 178 between the lowermost marking and the uppermost marking indicate to the user, when the tension adjusting wheel 124 is situated in alignment with such marking 178, the relative degree of resistance provided by the compression spring 138 when he presses on a corresponding plunger 128.

Figure 6:
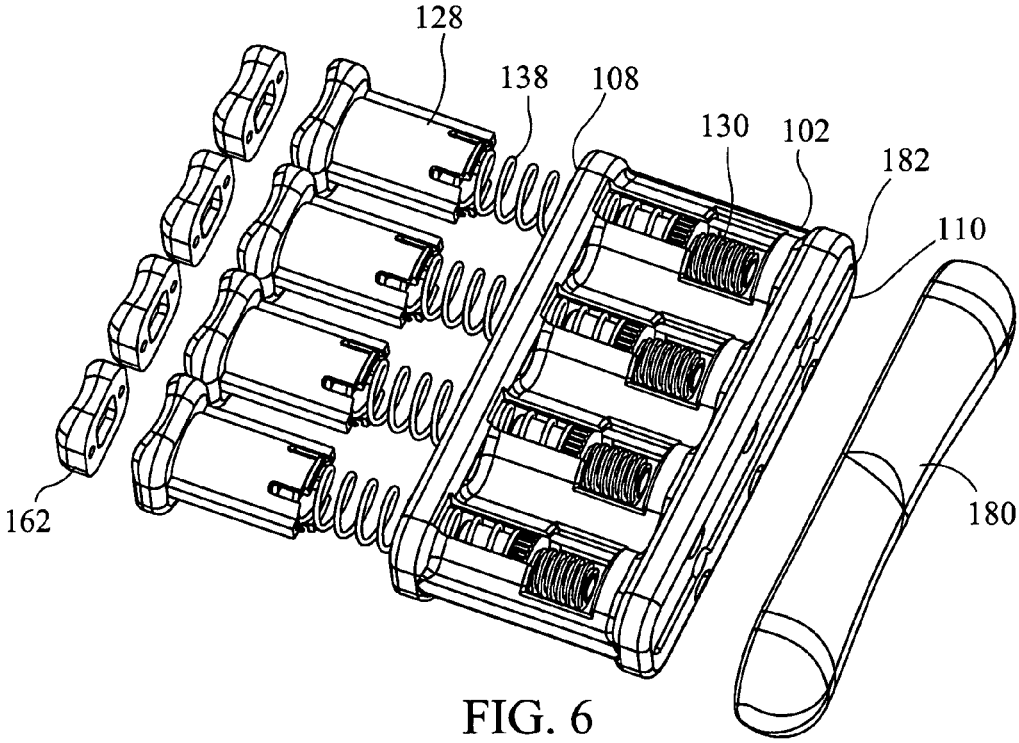
FIG. 6 is a partially exploded isometric view of the finger and hand exerciser illustrated by FIG. 1 of the drawings.
Figure 7:
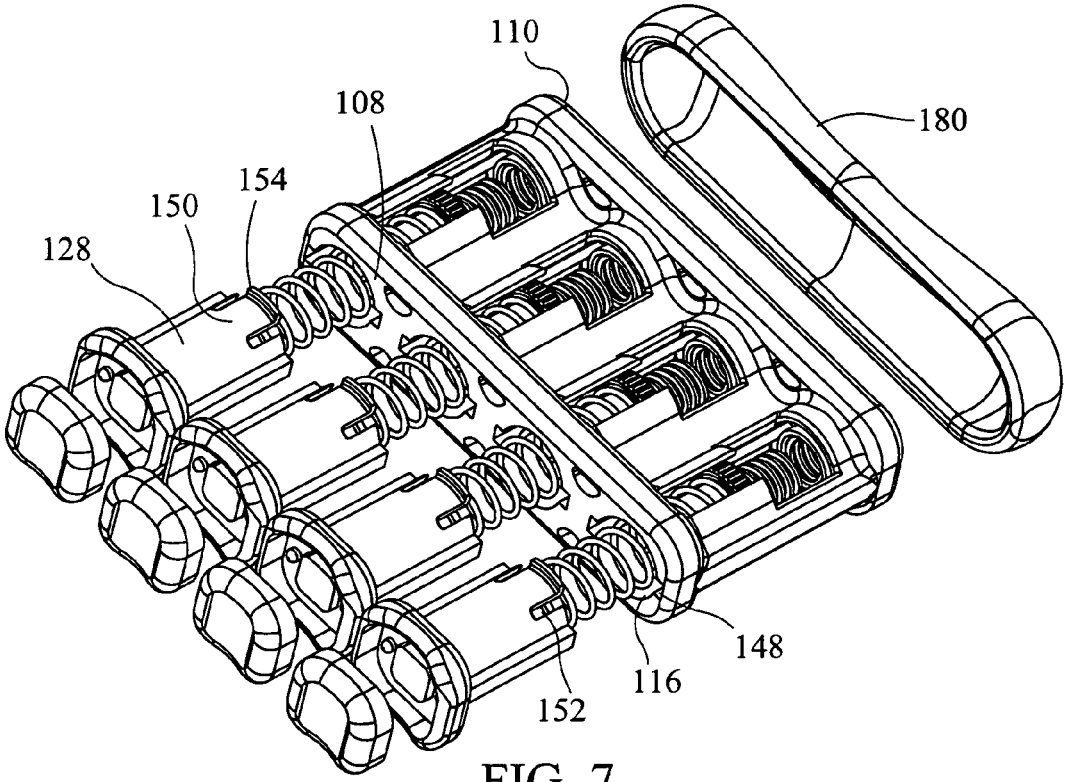
FIG. 7 is a partially exploded, isometric view, taken from another perspective, of the finger and hand exerciser of the present invention illustrated by FIG. 1 of the drawings.
Figure 8:
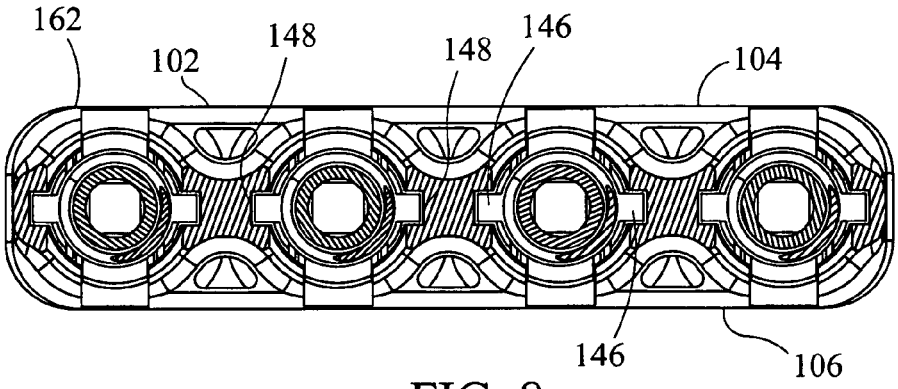
FIG. 8 is a transverse cross-sectional view of the finger and hand exerciser of the present invention illustrated by FIG. 1 of the drawings, looking towards the top of the exerciser.

As can be seen by FIGS. 6 and 7 of the drawings, the finger and hand exerciser 100 of the present invention may include a palm cushion 180 made from rubber or other elastic material which is fitted over and removable from the lower portion of the housing 102. This cushion 180 may be removed therefrom and fitted over the upper portions 156 of the plungers 128, as shown in FIG. 11. The finger and hand exerciser 100 may thus be repositioned in the user's hand such that the plungers 128, with the palm cushion 180 fitted thereon, rests in the palm of the user's hand, and the user's fingers now rest on the bottom wall 110 of the exerciser housing 102. With the exerciser 100 being held by the user in this manner, the plungers 128 of the exerciser are depressed in unison by the user, with one or more of his fingers resting on the bottom wall 110 of the housing 102. Alternatively, the exerciser 100 of the present invention may be held by the user between his thumb and other fingers in order to provide exercise to the user's thumb.

Another feature of the finger and hand exerciser 100 of the present invention is to allow the user to build up calluses on his fingers, which is advantageous when the user plays a stringed musical instrument, such as a guitar. In a preferred form of the invention, one or more ribs 182 extend along the length of the housing 102 and are situated on the bottom wall 110 thereof, and extend outwardly from the surface of the bottom wall 110. Normally, the ribs 182 are covered by the palm cushion 180 which is fitted over the lower portion of the housing 102. However, and as mentioned previously, the palm cushion 180 may be removed and placed atop the plungers 128, exposing the ribs 182 formed on the bottom wall 110 of the housing. The user would then place his fingers on one of the ribs 182 and hold the housing 102 upside down, with the palm cushion 180, fitted over the plungers 128, resting in the palm of his hand. By pressing down with his fingers on the housing ribs 182 against the resistance provided by the springs 138, the user may develop calluses on his finger tips in this manner of exercise using the finger and hand exerciser 100 of the present invention.

Figure 6A:
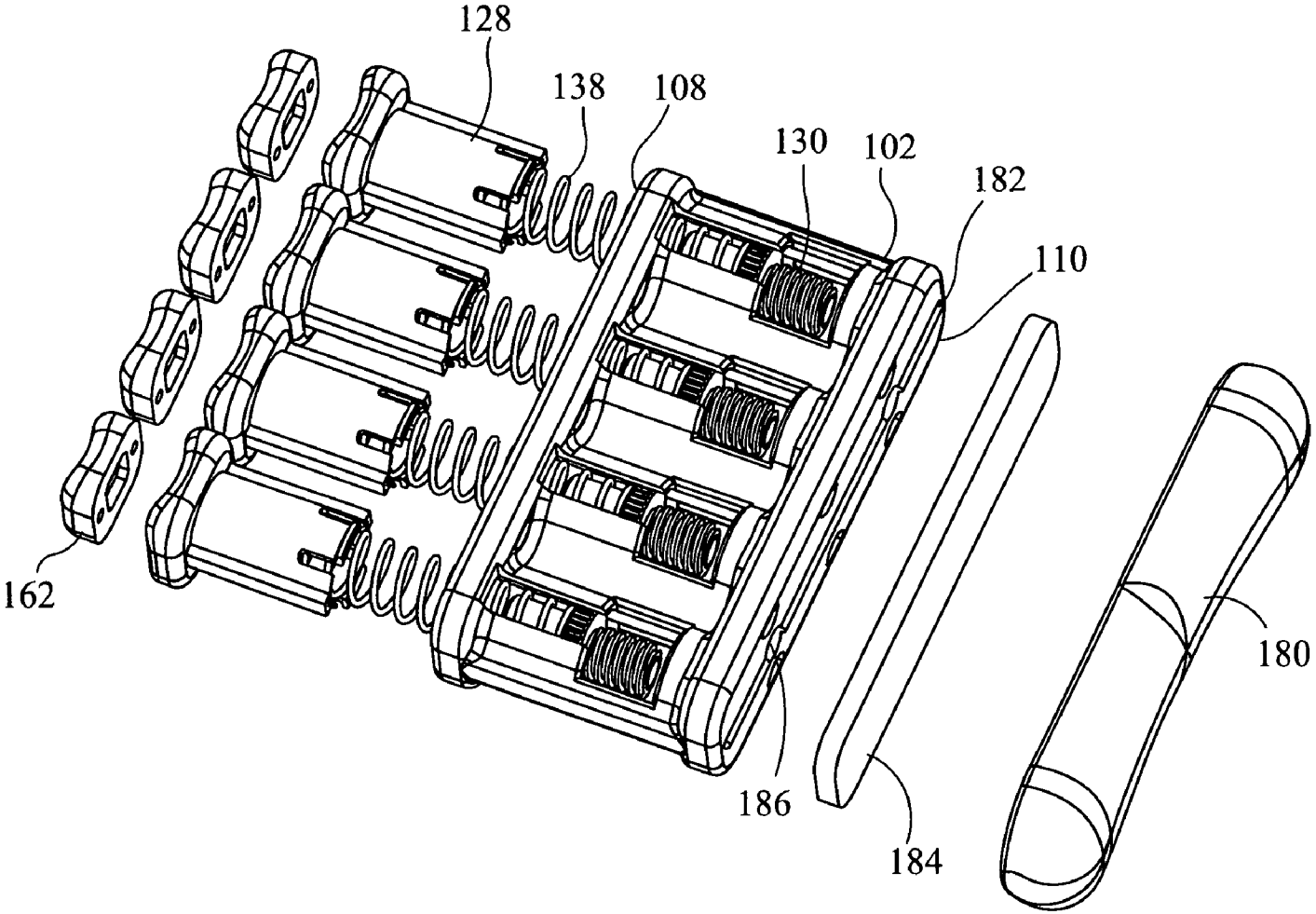
FIG. 6A is a partially exploded isometric view of the finger and hand exerciser illustrated by FIG. 1 of the drawings, and further showing a metronome attached thereto.

Another feature of the finger and hand exerciser of the present invention is that it is adaptable to receive an electronic or mechanical metronome 184. As shown in FIG. 6A, the metronome 184, the electronics and mechanics of which are not described herein, may be mounted to the bottom wall 110 of the housing 102 by a pair of screws (not shown) which are threadingly received by corresponding threaded bores 186 formed in the bottom wall 110 of the housing. In this embodiment, the palm cushion 180 is fitted over the metronome 184 attached to the bottom wall 110 of the housing, and may also extend over the lower portion of the housing 102, and may be removed therefrom. The cushion 180 protects the metronome 184 when the finger and hand exerciser 100 is being used, and may be temporarily removed therefrom to turn on or adjust the tempo of the metronome 184.

Figure 12:
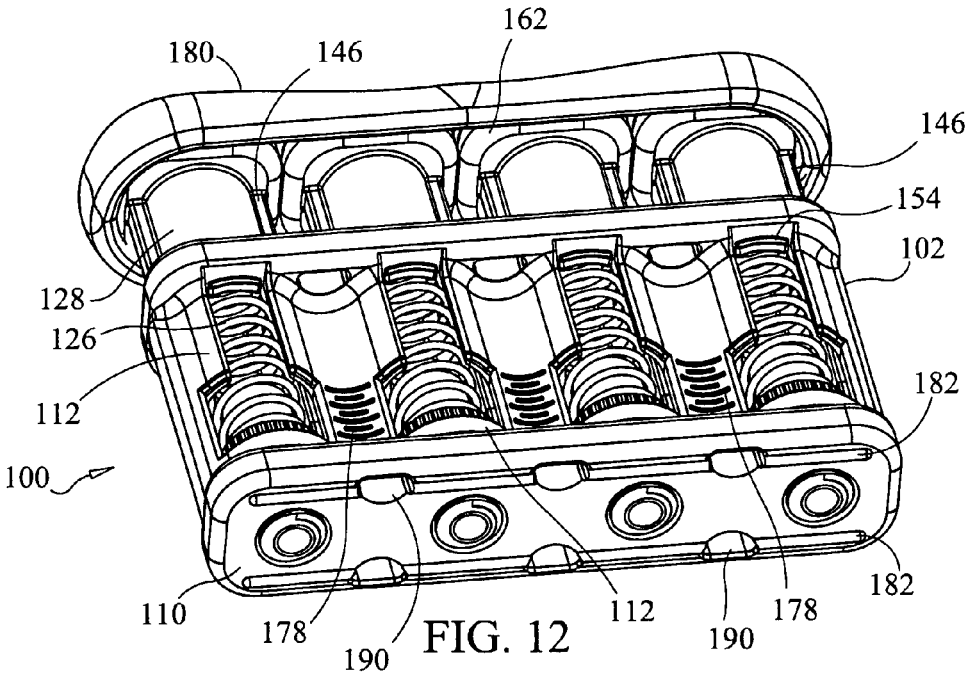
FIG. 12 a bottom isometric view which illustrates another version of the finger and hand exerciser of the present invention.
Figure 71:
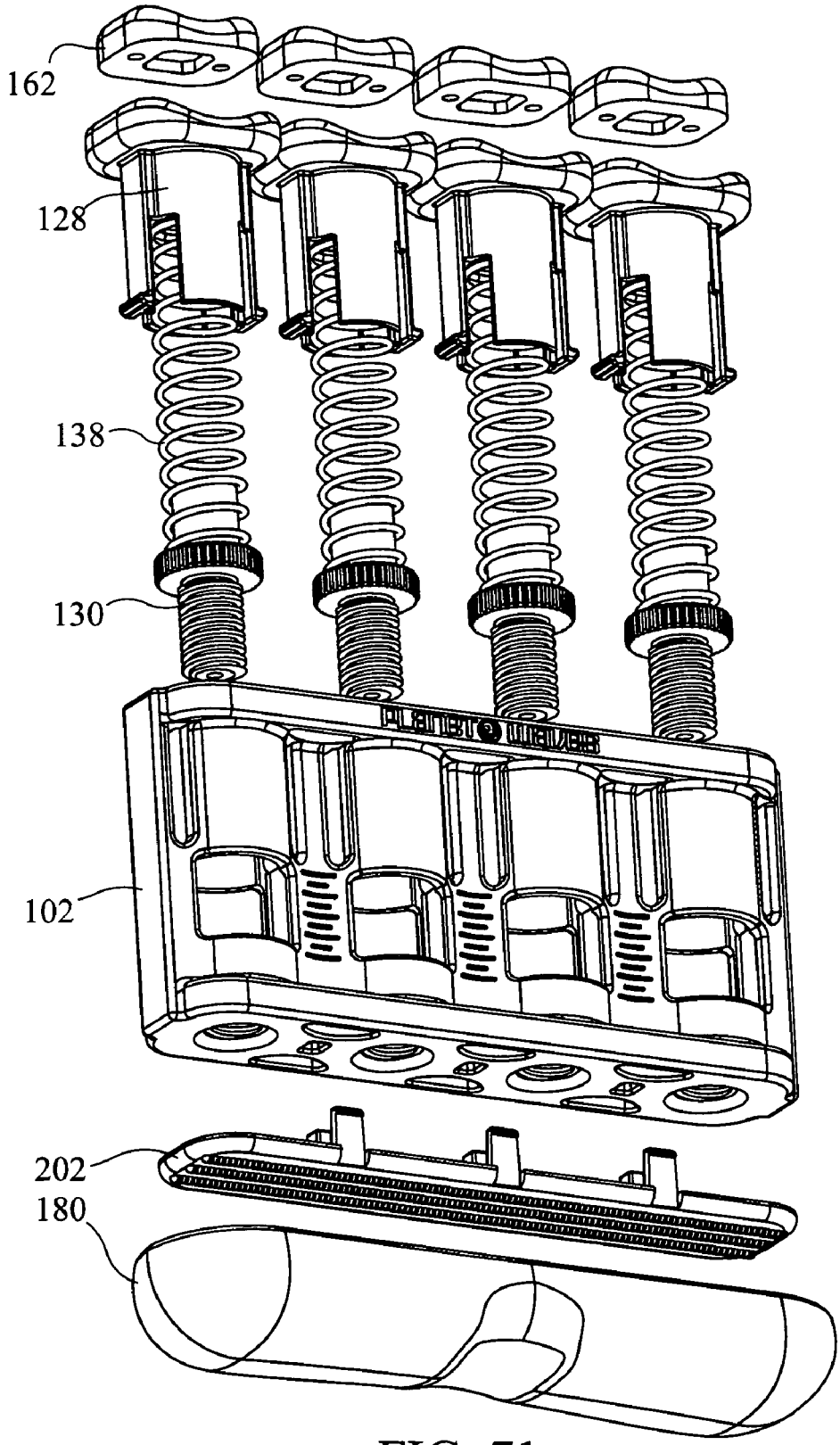
FIG. 71 is another partially exploded, isometric view of the finger and hand exerciser of the present invention in a preferred form.

Other versions of the finger and hand exerciser of the present invention are shown in FIGS. 12-71 of the drawings. These alternative embodiments operate similarly, and have similar structure, to the embodiments described previously and illustrated by FIGS. 1-11 of the drawings. These embodiments will now be described.

FIG. 12 illustrates a version of the finger and hand exerciser in which there are two ribs 182 situated on the bottom wall 110 of the housing 102, and which extend outwardly from the surface of the bottom wall 110. The ribs 182 are covered by the palm cushion 180, which is shown in FIG. 12 as having been removed and placed atop the plungers 128. Relief holes 190 are formed in the relatively thick bottom wall 110 of the housing 102. The relief holes 190 are provided to minimize the formation of sink marks which may have otherwise formed during cooling of the housing 102 after it is injection molded, and for economy of plastic and to promote more rapid cooling of the molded piece.

It should be further noted from FIG. 12 of the drawings that the finger and hand exerciser of the present invention has the tension adjustment members 130 shown in their lowest position on the housing 102 to reduce the tension in the compression springs 138, thereby reducing the necessary force required by the user to overcome the resistance of the springs against plungers 128.

Figure 13:
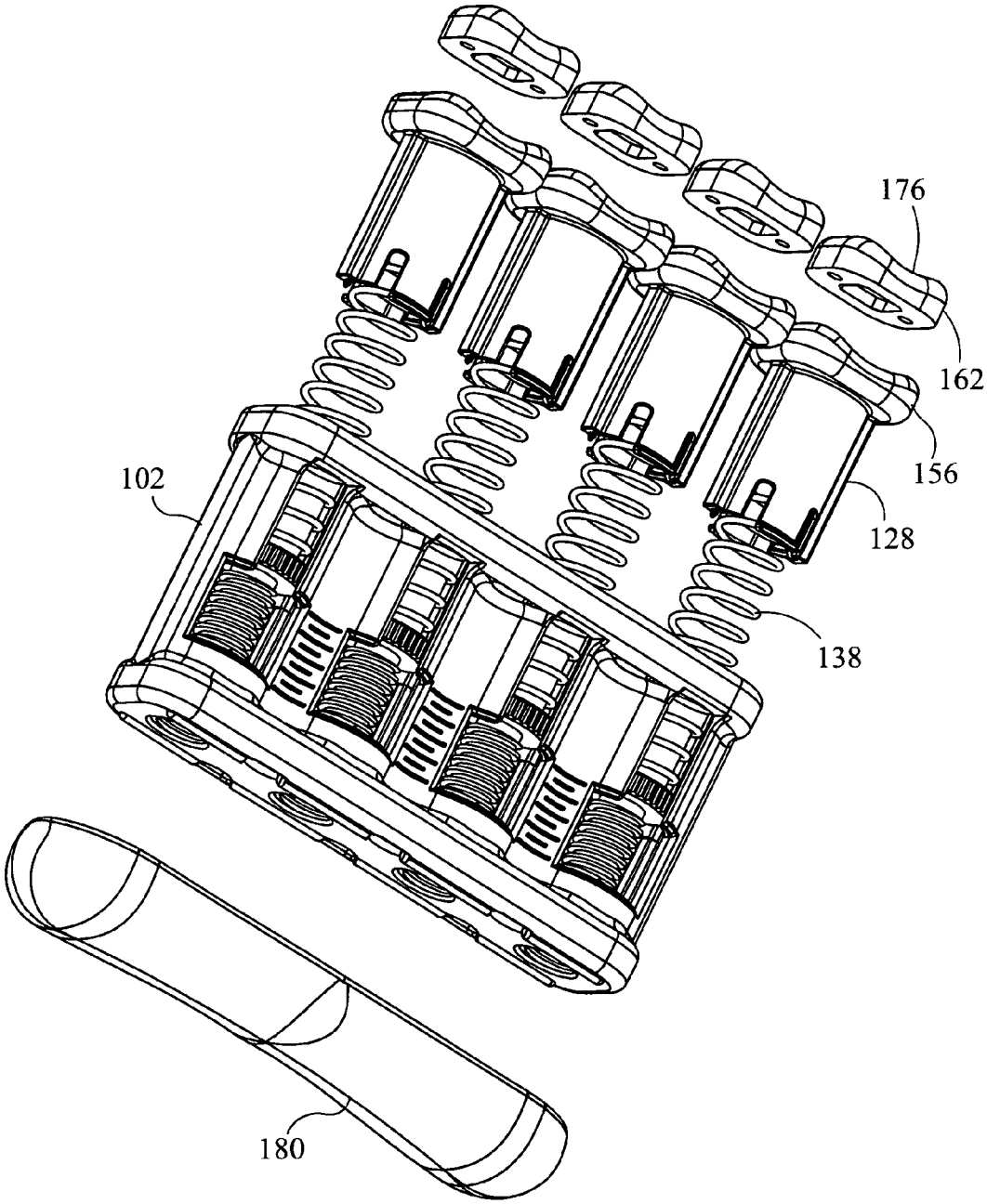
FIG. 13 is an exploded view of the finger and hand exerciser of the present invention illustrated by FIG. 12.

FIG. 13 is an exploded view of the finger and hand exerciser of the present invention illustrated by FIG. 12.

Figure 14:
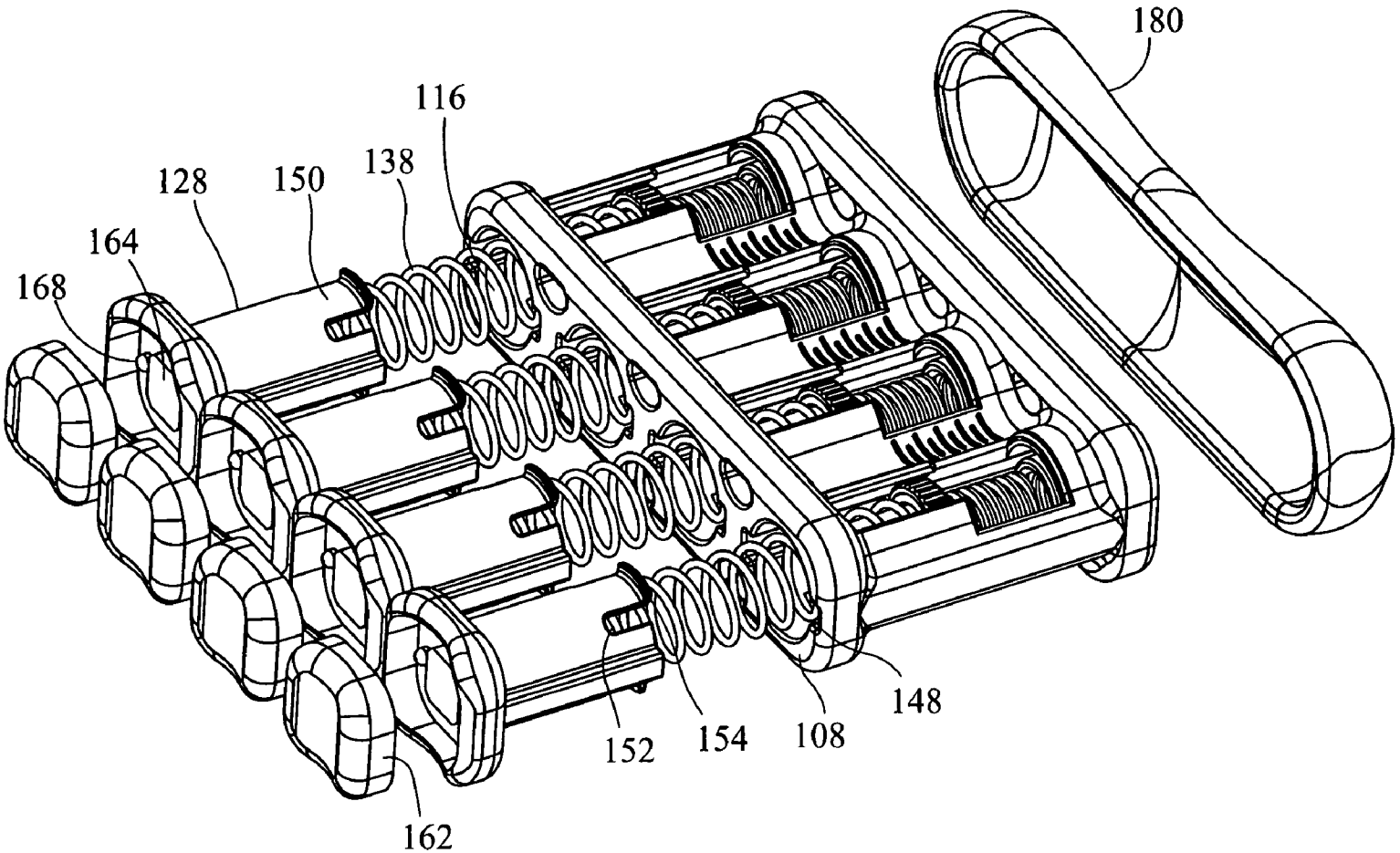
FIG. 14 is an exploded view of the finger and hand exerciser of the present invention shown in FIG. 12, taken from a different perspective than that shown in FIG. 13.

FIG. 14 is an exploded view of the finger and hand exerciser of the present invention shown in FIG. 12, taken from a different perspective than that shown in FIG. 13.

Figure 15:
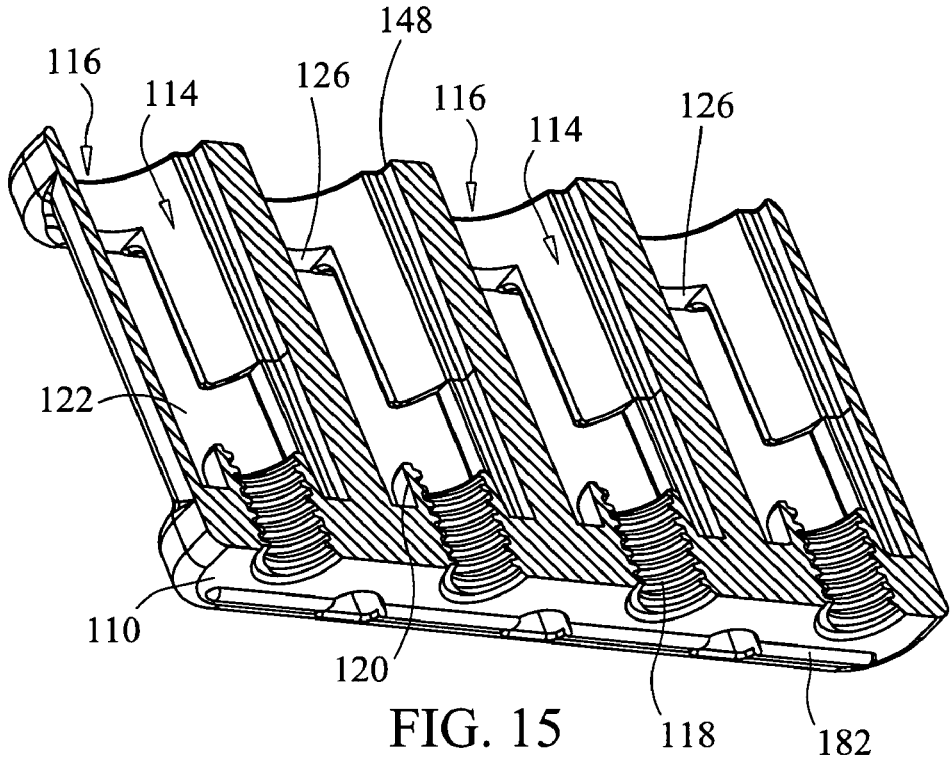
FIG. 15 is a partial cutaway of the housing of the finger and hand exerciser of the present invention shown in FIG. 12.

FIG. 15 is a partial cutaway of the housing 102 of the finger and hand exerciser of the present invention shown in FIG. 12. This view is very similar to that shown in FIG. 3.

Figure 16:
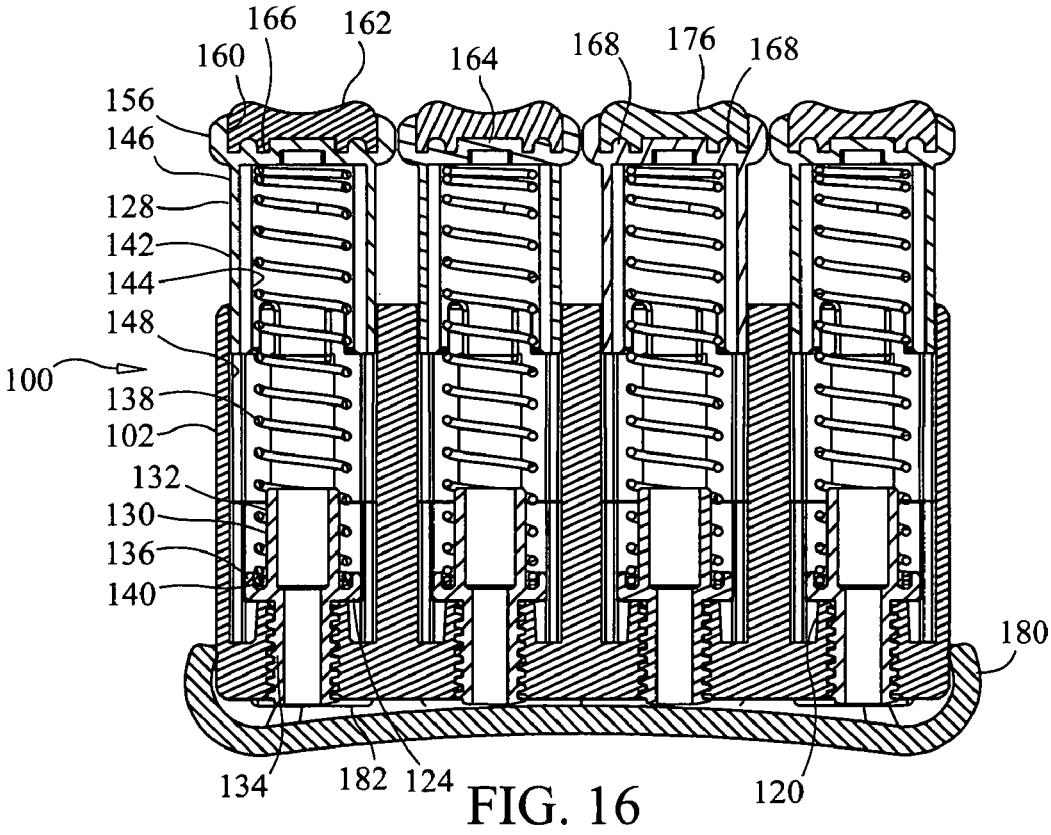
FIG. 16 is a longitudinal cross-sectional view of the finger and hand exerciser of the present invention shown in FIG. 12, with the palm cushion affixed to the bottom wall of the housing.

FIG. 16 is a longitudinal cross-sectional view of the finger and hand exerciser of the present invention shown in FIG. 12, with the palm cushion 180 affixed to the bottom wall 110 of the housing 102. This view is very similar to the view of the finger and hand exerciser shown in FIG. 4. It can be clearly seen from FIG. 16 that the tension adjustment members 130 are situated at their lowest position in housing 102 to provide the least resistance for the user. In this position, the tension adjustment members 130 allow the compression springs 138 to be in a relatively expanded state in order to reduce the tension in the springs 138.

Figure 17:
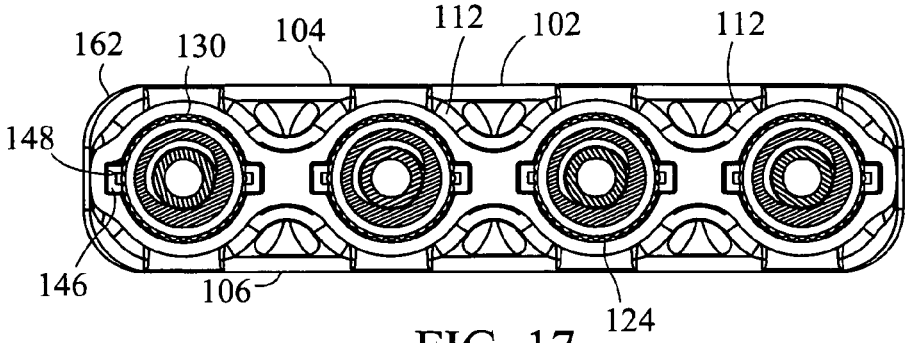
FIG. 17 is a cross-sectional view through the assembled housing of the finger and hand exerciser of the present invention shown in FIG. 12.

FIG. 17 is a cross-sectional view through the assembled housing 102 of the finger and hand exerciser 100 shown in FIG. 12. This view is very similar to the view shown in FIG. 8.

Figure 18:
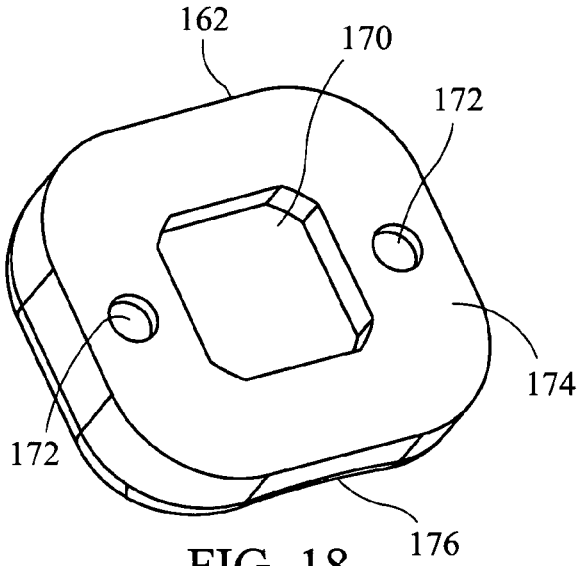
FIG. 18 is a bottom isometric view of one of the finger pads of the finger and hand exerciser of the present invention shown in FIG. 12 of the drawings.

FIG. 18 is a bottom isometric view of one of the finger pads 162 of the finger and hand exerciser shown in FIG. 12 of the drawings. This view is very similar to that shown in FIG. 10.

Figure 19:
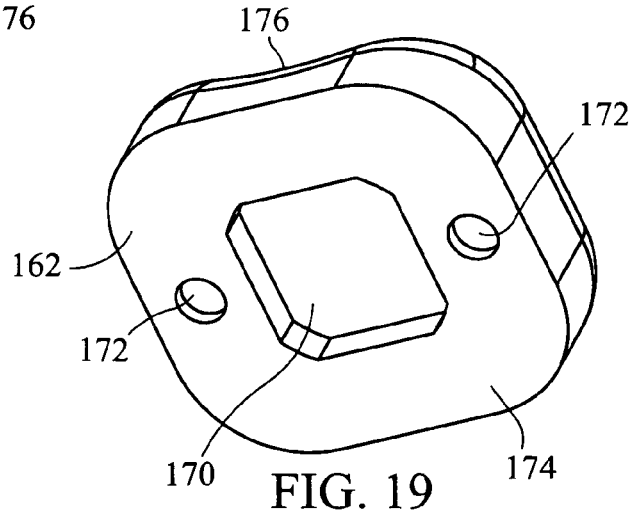
FIG. 19 is a bottom isometric view of one of the finger pads of the finger and hand exerciser of the present invention shown in FIG. 12, taken from a different perspective than that of FIG. 18.

FIG. 19 is a bottom isometric view of one of the finger pads 162 of the finger and hand exerciser shown in FIG. 12, taken from a different perspective than that of FIG. 18. Again, this view is very similar to that shown in FIG. 10.

Figure 20:
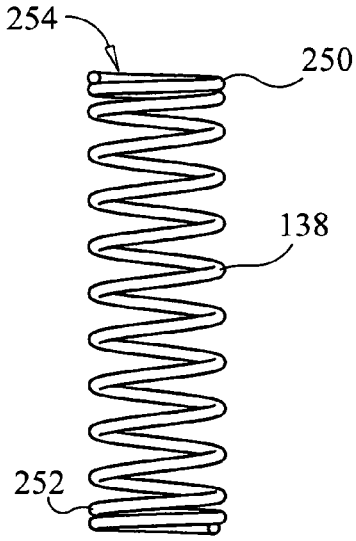
FIG. 20 is an isometric view of one of the compression springs used in the various embodiments of the finger and hand exerciser of the present invention.

FIG. 20 is an isometric view of one of the compression springs 138 used in the various embodiments of the finger and hand exerciser 100 described herein.

FIGS. 21-71 of the drawings relate to another preferred form of the finger and hand exerciser of the present invention. This particular embodiment will now be described in detail.

With this particular embodiment, the plunger 128 is slightly modified from the previous version of the finger and hand exercisers shown in FIGS. 1-11. Here, the tabs 150 of the plunger 128 are moved ninety degrees from the plunger 128 shown in FIGS. 1-11 so that they are on diametrically opposite sides of the plunger and situated where ribs 146 of the earlier-described embodiment were located. The tabs 150 extend in the longitudinal axial direction of the plunger 128, as shown in FIGS. 22-26 of the drawings. A stiffening rib 196 situated on an inside surface of each tab 150 extends along the length of each tab 150 and project outwardly from the inside surface of the tab. The ribs 196 are provided for stiffening the tabs 150, but not so much as to prevent the tabs 150 from being resilient and movable in a radially inward and outward direction with respect to the cylindrical portion 142 of each plunger. At the free end of each tab 150 of each plunger 128 is situated a shoulder 154 which extends outwardly from the outer surface of each tab 150. The tabs 150 are received in corresponding grooves 198 formed in the housing 102, which grooves 198 are similar in many respects to the grooves 148 of the finger and hand exerciser described previously and illustrated by FIGS. 1-11 of the drawings. Each groove 198 communicates with an enlarged slot 200 formed below a corresponding groove 198. Thus, the slots 200 are situated on diametrically opposite sides of the chamber 114 which receives the cylindrical portion 142 of a corresponding plunger 128 (see FIG. 40).

The finger and hand exerciser of the embodiment shown in FIGS. 21-71 of the drawings is assembled in a manner similar to that described previously with respect to the embodiments shown in FIGS. 1-11. That is, the plungers 128 are inserted through the circular openings 116 formed in the top wall 108 of the housing 102, after a tension adjustment member 130 and compression spring 138 are placed in a corresponding chamber. The tabs 150 of the plunger 128 are aligned with corresponding grooves 198 and slots 200, and the plunger 128 is inserted into its corresponding chamber 114 formed in the housing 102. The shoulders 154, which extend outwardly from tabs 150, are compressed radially inwardly by the housing interior side walls which define the grooves 198. As the plunger 128 is forced downwardly into its respective chamber 114, the shoulder 154 on each tab 150 passes the end of a respective groove 198 and is captively received by a corresponding slot 200 by resiliently expanding radially outwardly from the plunger 128. Thus, the shoulder 154 on each tab 150 resides and slides in a corresponding slot 200, while each tab 150 resides and slides within a corresponding groove 198.

The tabs 150 and grooves 198 are dimensioned so that the tabs 150 are closely received by the grooves 198 to allow the plunger 128 to move reciprocatingly within chamber 114. Also, the cooperation of the tabs 150 and their respective grooves 198 prevent the plunger 128 from rotating on housing 102 as it is moved reciprocatingly within chamber 114 under finger pressure.

Figure 27:
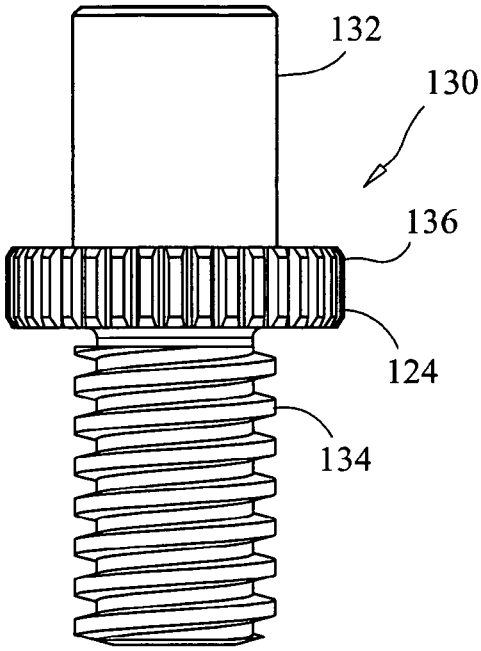
FIG. 27 is a side view of each tension adjustment member used in the finger and hand exerciser of a preferred embodiment.

FIG. 27 is a side view of each tension adjustment member 130 used in the finger and hand exerciser of this preferred embodiment. The tension adjustment members 130 shown in FIG. 27 have similar structure to those used in the embodiments described earlier and shown in FIGS. 1-11.

Figure 28:
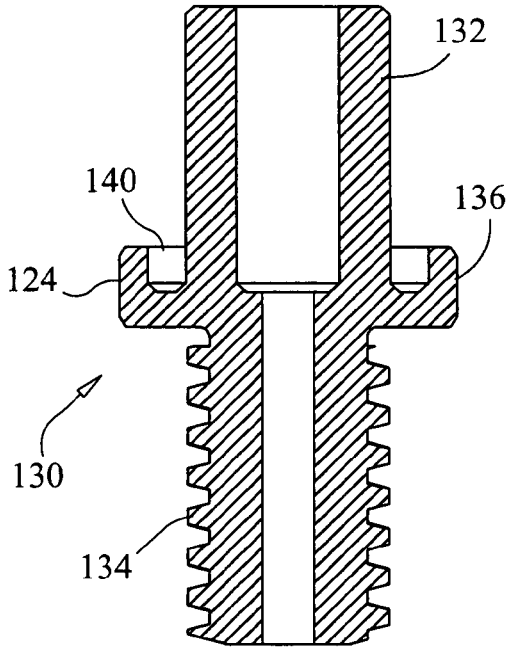
FIG. 28 is a cross-sectional view of the tension adjustment member shown in FIG. 27.

FIG. 28 is a cross-sectional view of the tension adjustment member 130 shown in FIG. 27.

Figure 29:
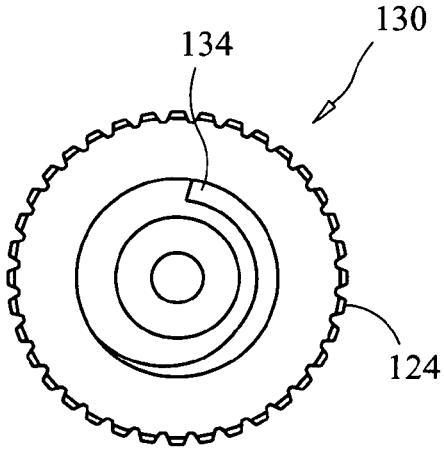
FIG. 29 is a bottom view of the tension adjustment member shown in FIG. 27.

FIG. 29 is a bottom view of the tension adjustment member 130 shown in FIG. 27.

Figure 30:
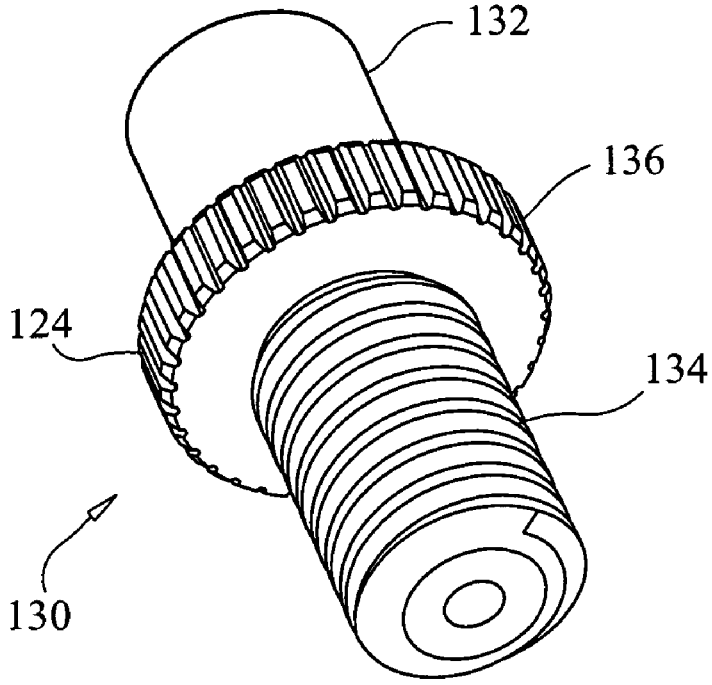
FIG. 30 is a bottom isometric view of the tension adjustment member shown in FIG. 27.

FIG. 30 is a bottom isometric view of the tension adjustment member 130 shown in FIG. 27.

Figure 31:
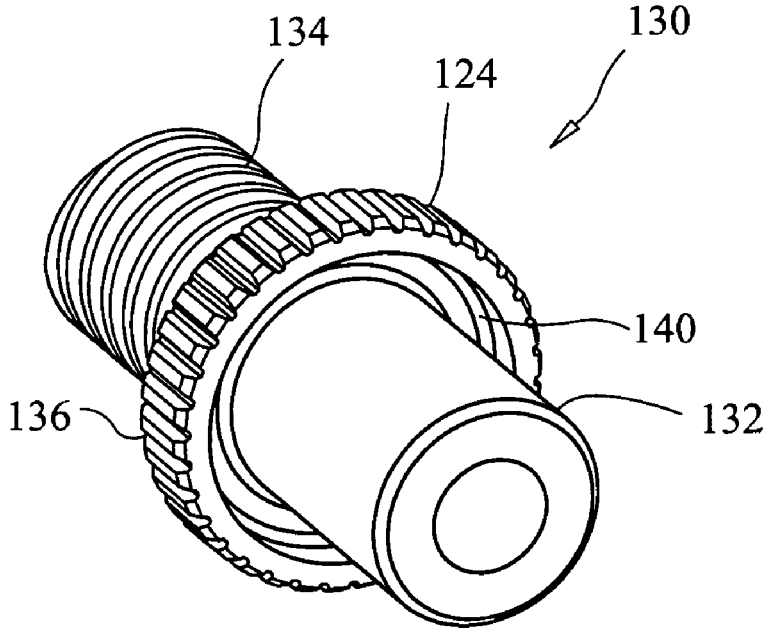
FIG. 31 is a top isometric view of the tension adjustment member shown in FIG. 27.

FIG. 31 is a top isometric view of the tension adjustment member 130 shown in FIG. 27.

Figure 32:
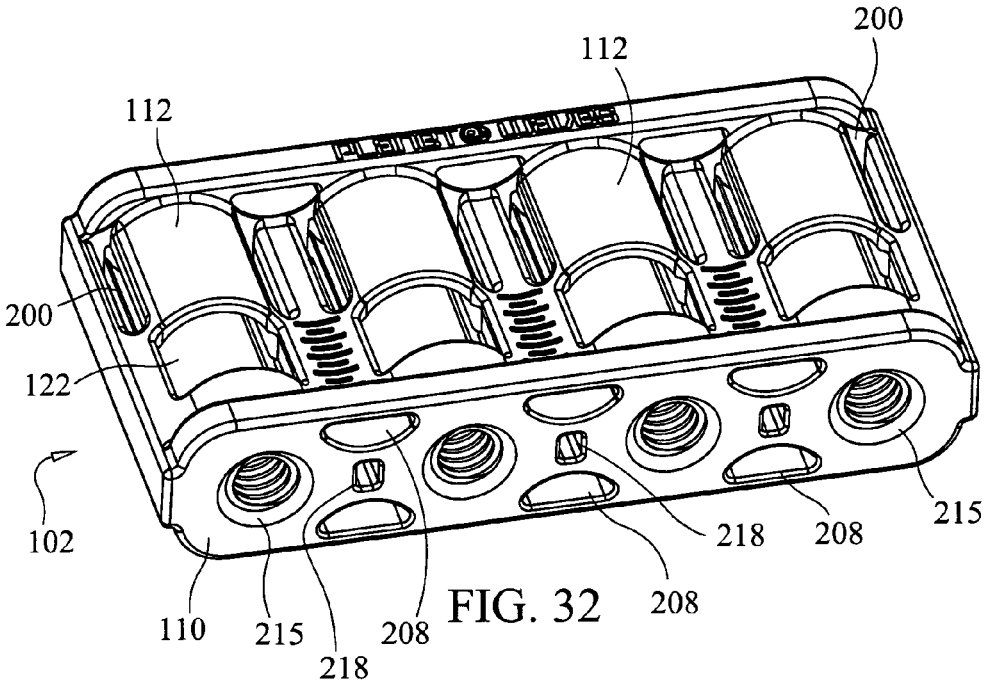
FIG. 32 is a bottom isometric view of the finger and hand exerciser of the present invention in a preferred form.

FIG. 32 is a bottom isometric view of the finger and hand exerciser of the present invention in its preferred form.

Figure 33:
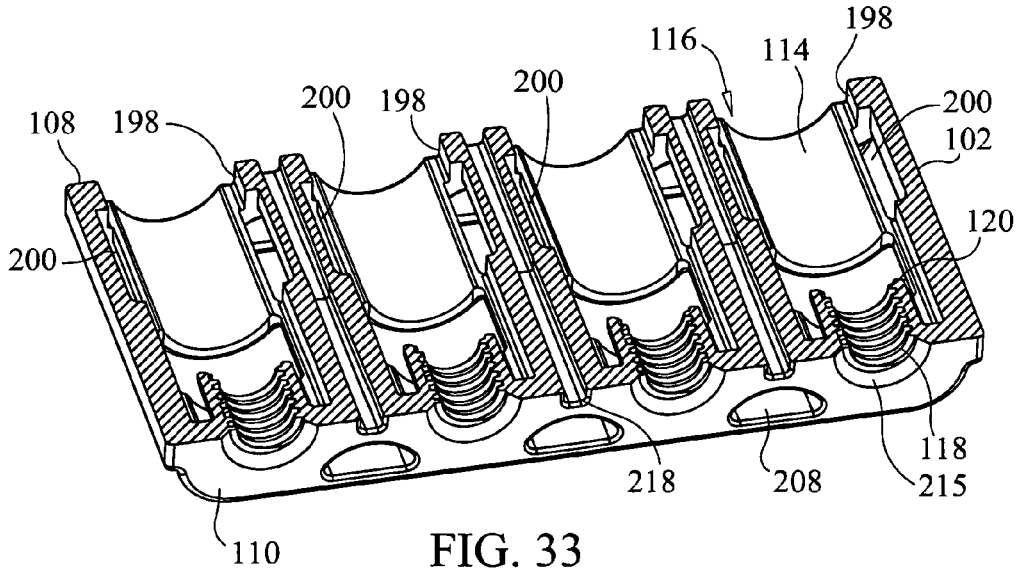
FIG. 33 is a longitudinal cross-sectional view of the housing of the finger and hand exerciser in a preferred form.

FIG. 33 is a longitudinal cross-sectional view of the housing 102 of the finger and hand exerciser in its preferred form.

Figure 34:
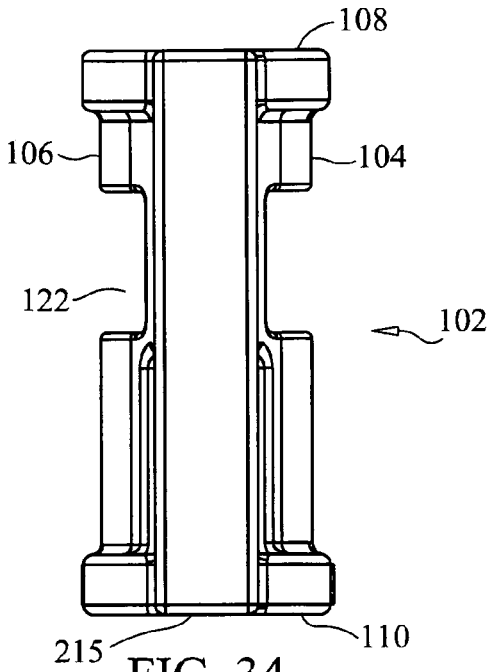
FIG. 34 is an end view of the housing of the finger and hand exerciser of the present invention in a preferred form.

FIG. 34 is an end view of the housing 102 of the finger and hand exerciser of the present invention in its preferred form.

Figure 35:
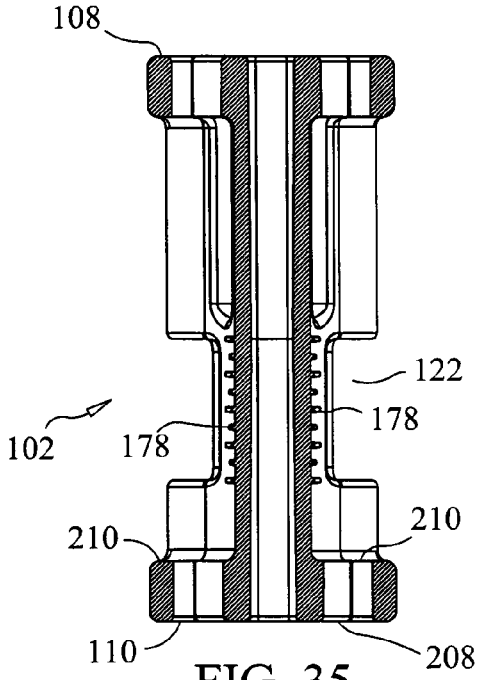
FIG. 35 is a transverse cross-sectional view of the housing of the finger and hand exerciser of the present invention in a preferred form.

FIG. 35 is a transverse cross-sectional view of the housing 102 of the finger and hand exerciser of the present invention in its preferred form.

Figure 36:
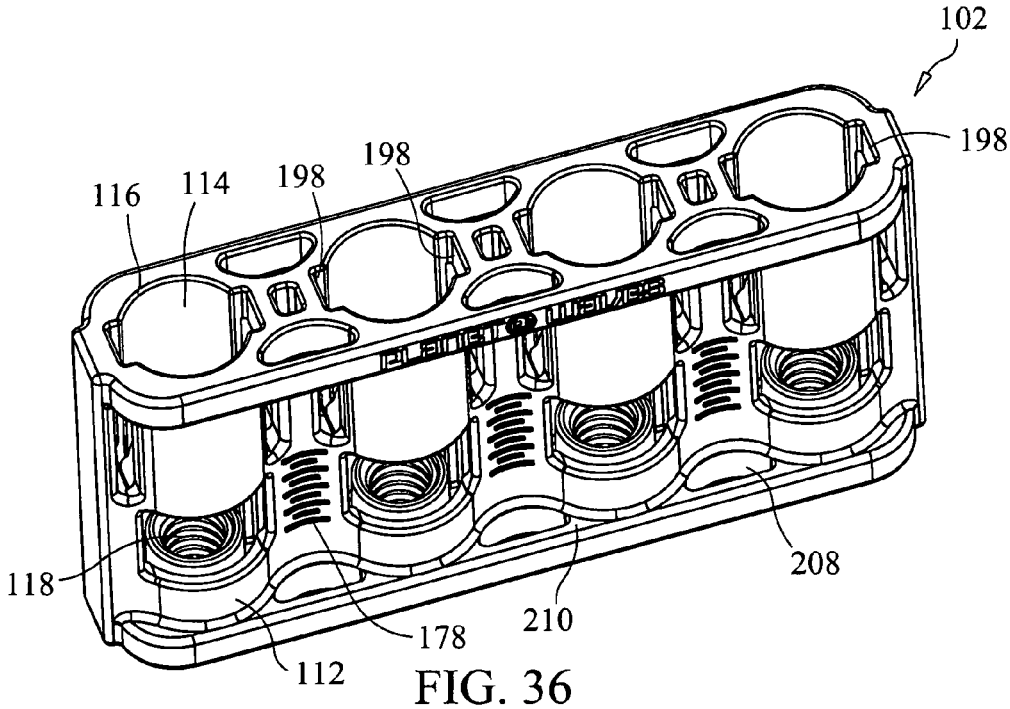
FIG. 36 is an isometric view of the housing of the finger and hand exerciser of the present invention in a preferred form.

FIG. 36 is an isometric view of the housing 102 of the finger and hand exerciser of the present invention in its preferred form.

Figure 37:
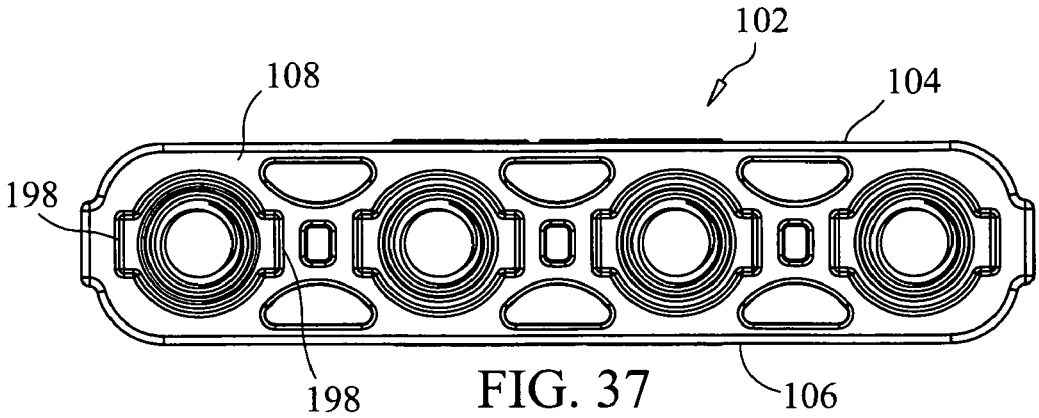
FIG. 37 is a bottom view of the finger and hand exerciser of the present invention, partially assembled but without the palm cushion or a callus rib plate.

FIG. 37 is a top view of the housing of the finger and hand exerciser of the present invention.

Figure 38:
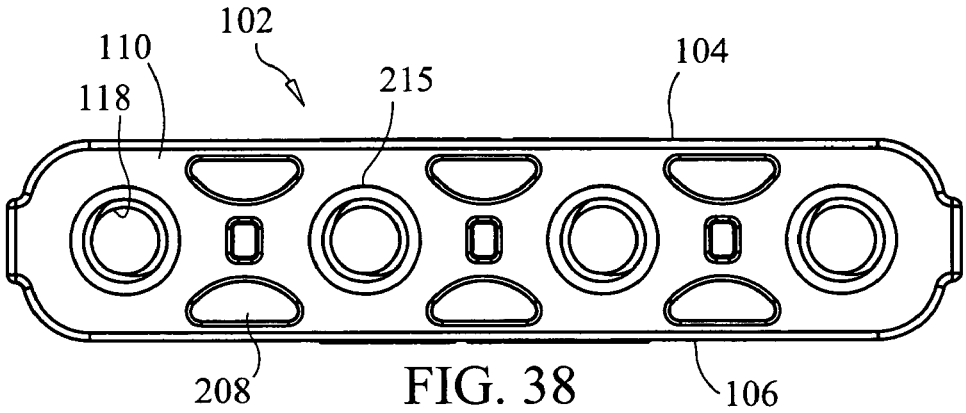
FIG. 38 is a bottom view of the housing of the finger and hand exerciser of the present invention in a preferred form.

FIG. 38 is a bottom view of the housing of the finger and hand exerciser of the present invention in a preferred form.

Figure 39:
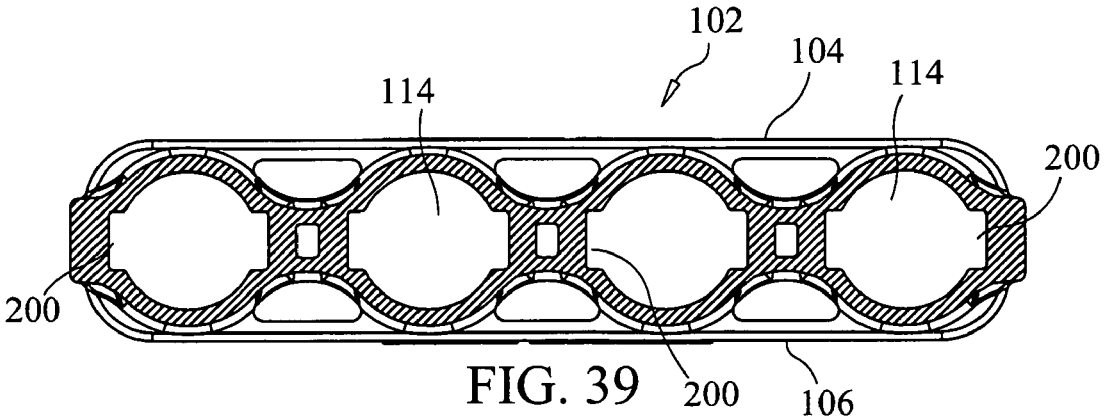
FIG. 39 is a cross-sectional view of the housing of the finger and hand exerciser of the present invention in a preferred form.

FIG. 39 is a cross-sectional view of the housing 102 of the finger and hand exerciser of the present invention in its preferred form.

Figure 40:
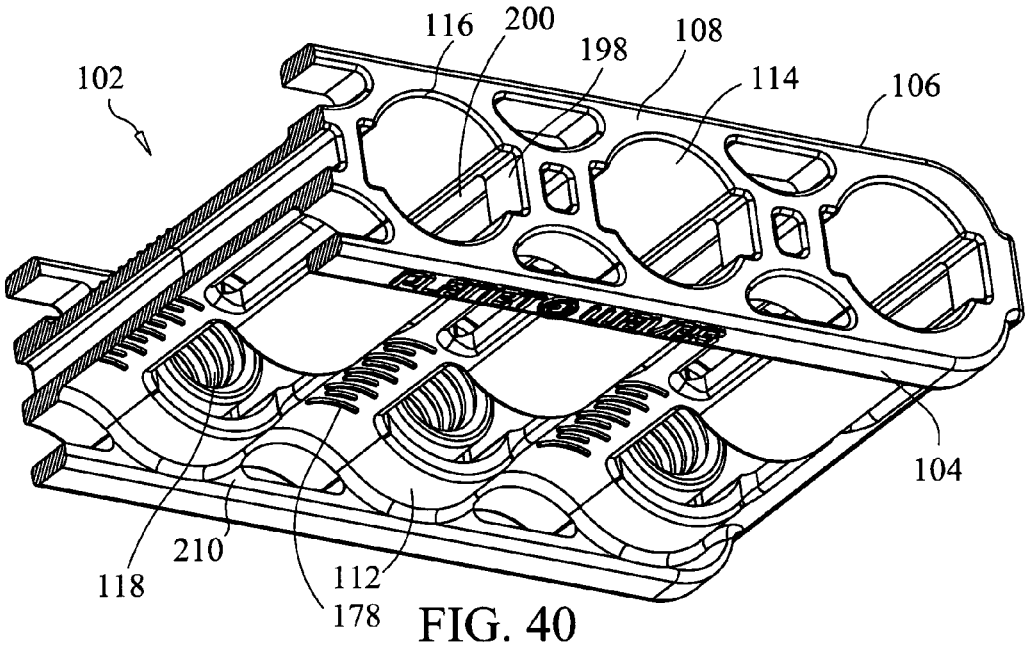
FIG. 40 is a top isometric view of the housing, transversely sectioned and with a portion thereof removed, of the finger and hand exerciser of the present invention in a preferred form.

FIG. 40 is a top isometric view of the housing 102, transversely sectioned and with a portion thereof removed, of the finger and hand exerciser of the present invention in its preferred form.

Figure 41:
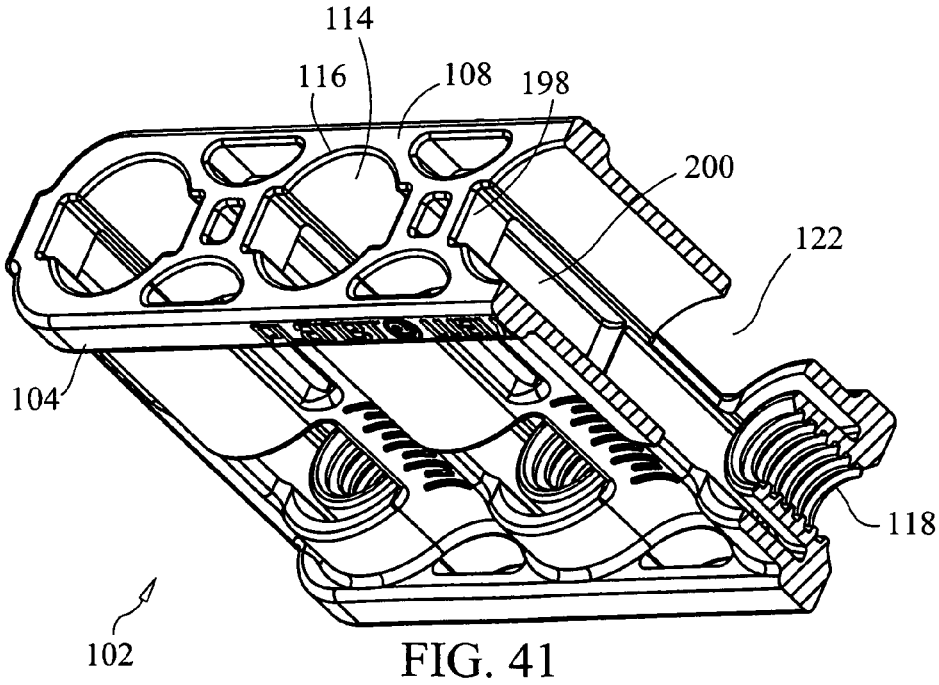
FIG. 41 is another isometric view of the housing, also transversely sectioned with a portion thereof removed, of the finger and hand exerciser of the present invention in a preferred form.

FIG. 41 is another isometric view of the housing 102, also transversely sectioned with a portion thereof removed, of the finger and hand exerciser of the present invention in its preferred form.

Figure 42:
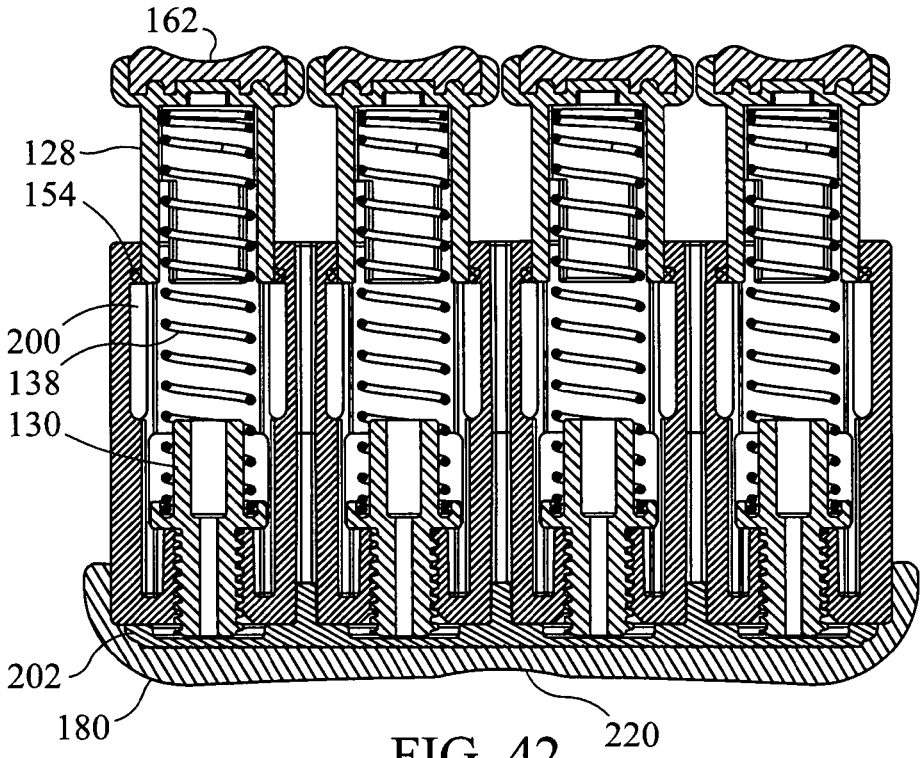
FIG. 42 is a longitudinal cross-sectional view of the assembled finger and hand exerciser of the present invention in a preferred form.

FIG. 42 is a longitudinal cross-sectional view of the assembled finger and hand exerciser of the present invention in its preferred form. It should be noted from FIG. 42 that the finger and hand exerciser has its plungers 128 in their most outwardly extended position with respect to housing 102, and each tension adjustment member 130 is situated at its lowest position within housing 102 to provide the least resistance for the user during an exercise regimen.

Figure 43:
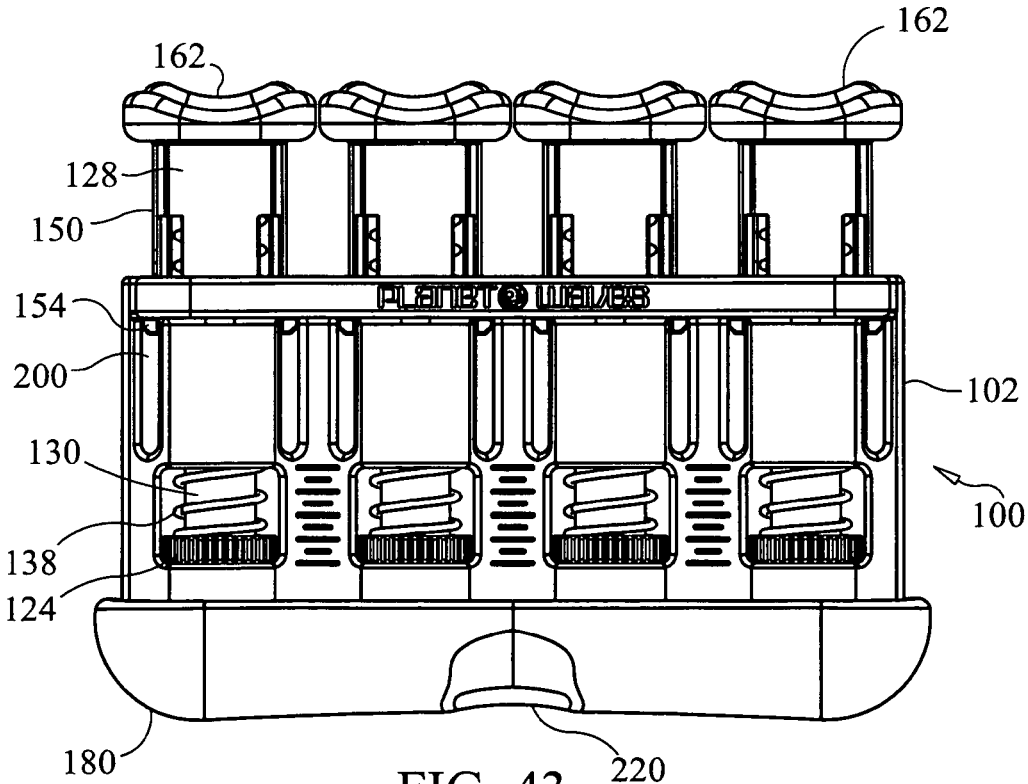
FIG. 43 is a side view of the finger and hand exerciser of the present invention in a preferred form.

FIG. 43 is a side view of the finger and hand exerciser of the present invention in its preferred form. Again, the finger and hand exerciser is shown with the tension adjustment members 130 in their lowest position on housing 102 and with the plungers 128 in their non-depressed state.

Figure 44:
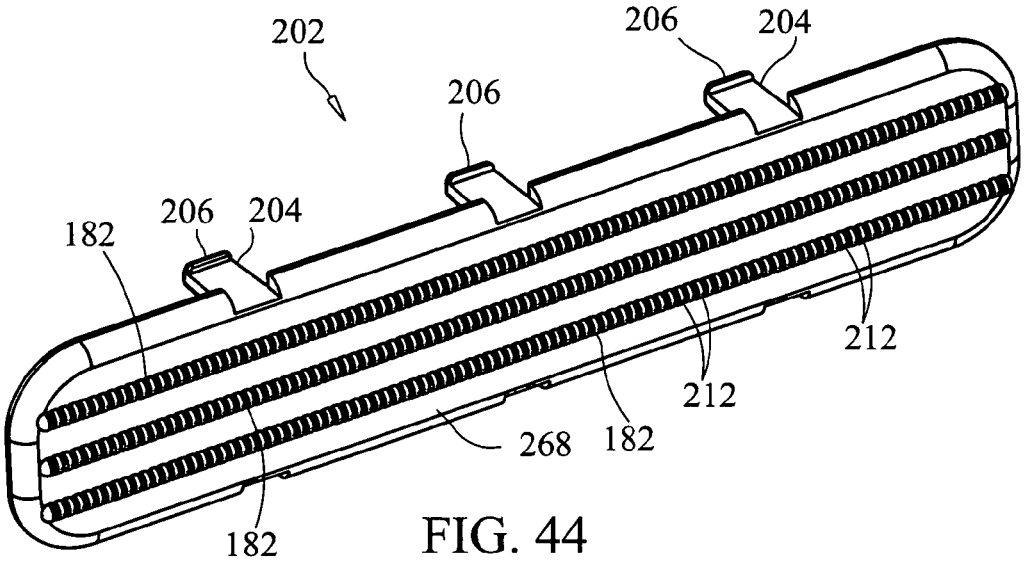
FIG. 44 is an isometric view of a callus rib plate of the finger and hand exerciser of the present invention in a preferred form.

FIG. 44 is an isometric view of a callus rib plate 202 of the finger and hand exerciser of the present invention in its preferred form. The callus rib plate 202 includes a plurality of resilient prongs 204, having outwardly and perpendicularly extending shoulders 206 situated at the free end of each plate prong 204. The plate prongs 204 are received by corresponding openings 208 formed through the bottom wall 110 of housing 102 and extending through the housing 102 and through recessed portions 210 situated between the cylindrical wall protrusions 112 which define the chambers 114. The openings 208 are situated on the housing 102 to be in alignment with plate prongs 204 so that the callus rib plate 202 may be positioned on the housing 102 with its inner surface 266 facing the bottom wall 110. The callus rib plate 202 is forced against the bottom wall 110 of the housing 102 such that the plate prongs 204 are received by corresponding openings 208. The plate prongs 204 are resilient and are deflected inwardly of the callus rib plate 202 when they are received by corresponding openings 208. When the free end of each plate prong 204 is fully received by its corresponding opening 208 formed in the housing 102, they resiliently move from their inwardly deflected position to an outwardly expanded position such that the plate shoulders 206 situated on the free ends of the plate prongs 204 hook on to the recessed portion 210 of housing 102. In this matter, the callus rib plate 202 is secured in place to the bottom wall 110 of housing 102.

The outer surface of the rib plate 202 includes one or more ribs 182 (three parallel ribs are shown in FIG. 44) which extend along the length of callus rib plate 202, in a similar manner as the ribs 182 extend along the bottom wall 110 of the finger and hand exerciser described previously and shown in FIGS. 1-11 of the drawings. Even more preferably, each rib 182 may include a series of bumps or projections 212 situated along its length to simulate the feel of wire-wound guitar strings and to help build up calluses on the user's fingertips in less time. In this embodiment of the finger and hand exerciser 100 of the present invention, no callus ribs 182 are formed directly on the bottom wall 110 of the housing 102, since the callus rib plate 202 includes such ribs 182.

The callus rib plate 202 in this preferred form of the finger and hand exerciser of the present invention is provided as a separate piece which may be attachable to the bottom wall 110 of the housing 102 if the user so desires. Or, the user may choose not to attach the callus rib plate 202 to the housing 102, for example, if the finger and hand exerciser of the present invention is used for health purposes, or sports purposes, to strengthen the grip or fingers of the user, or where the user plays a wind musical instrument rather than a stringed musical instrument.

Figure 45:
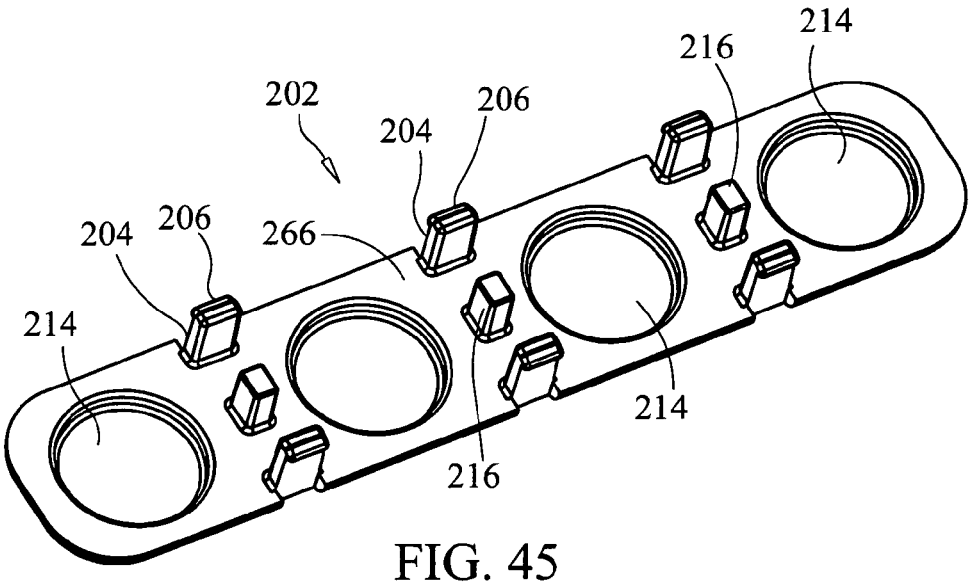
FIG. 45 is another isometric view of the callus rib plate, showing the inside surface of the plate.

FIG. 45 is another isometric view of the callus rib plate 202, showing the inside surface of the plate. As can be seen, a plurality of circular recesses 214 are formed on the inside surface of the callus rib plate 202. Each circular recess 214 is aligned with a corresponding opening 215 in the bottom wall 110 of the housing 102, in the event that the threaded lower portion 134 of each tension adjustment member 130 extends slightly outwardly from the bottom wall 110 of the housing 102. Such openings 215 in the bottom wall 110 are provided to allow even further adjustment of the tension provided by the compression springs 138 by greater axial movement of the tension adjustment members 130. Also, it can be seen from FIG. 45 that locator posts 216 formed as projections which extend outwardly from the inner surface of the callus rib plate 202 are provided. Such locator posts 216 are received by corresponding openings 218 formed in the bottom wall 110 of housing 102, and are provided to help properly align the callus rib plate 202 on the bottom wall 110 when the callus rib plate 202 is being affixed to the housing 102 of the finger and hand exerciser.

Figure 46:
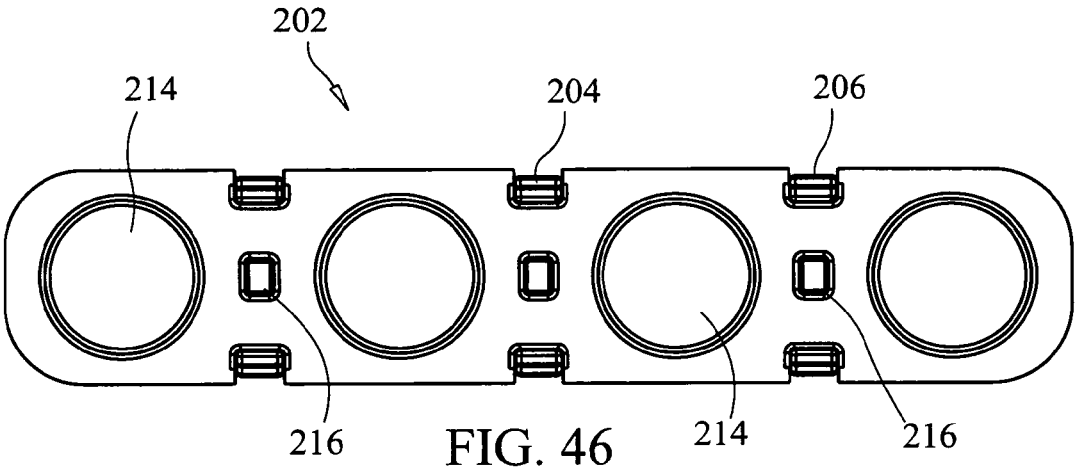
FIG. 46 is a top view of the callus rib plate shown in FIGS. 44 and 45.

FIG. 46 is a top view of the callus rib plate 202 shown in FIGS. 44 and 45.

Figure 47:
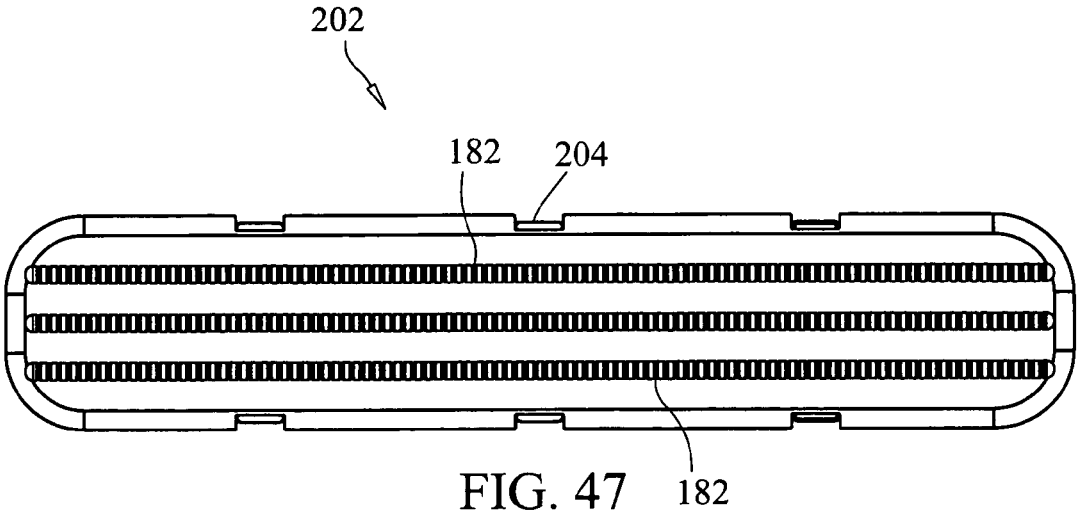
FIG. 47 is a bottom view of the callus rib plate shown in FIGS. 44-46.

FIG. 47 is a bottom view of the callus rib plate 202 shown in FIGS. 44-46.

Figure 21:
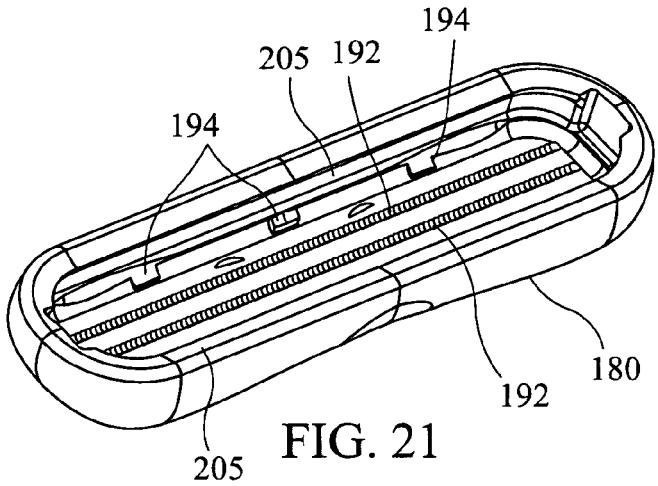
FIG. 21 is an isometric view of the palm cushion of the finger and hand exerciser of the present invention shown in FIG. 12 of the drawings.
Figure 22:
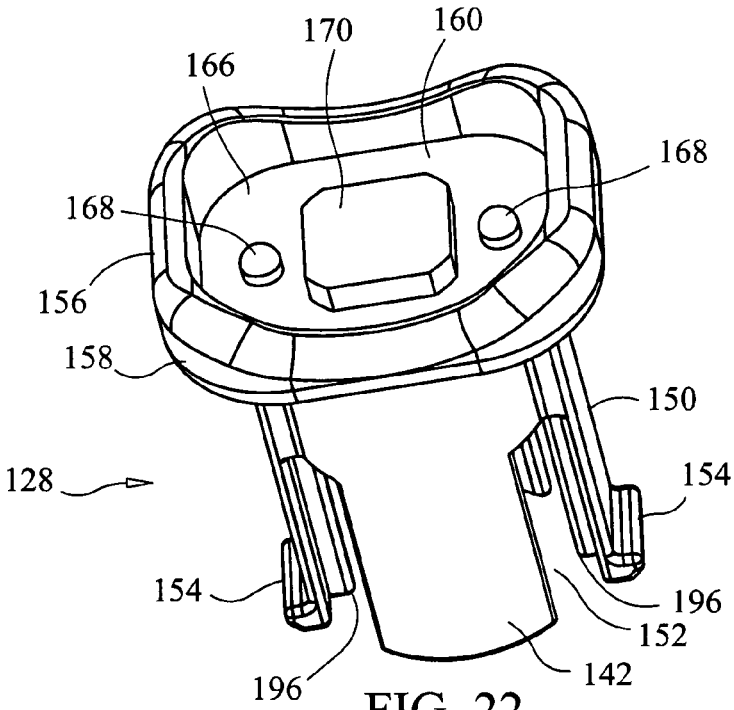
FIG. 22 is a top isometric view of the finger plunger of another version of the finger and hand exerciser of the present invention.
Figure 23:
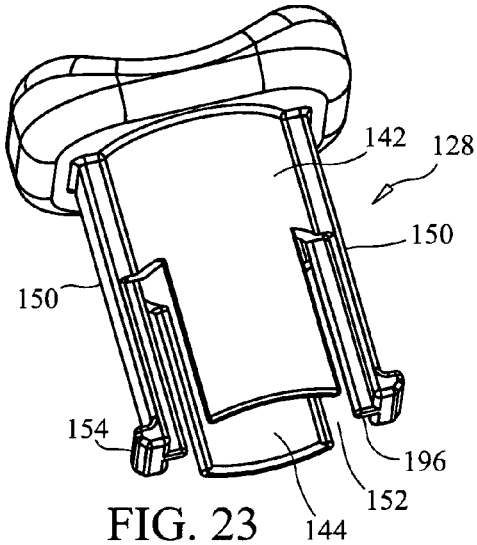
FIG. 23 is a bottom isometric view of the finger plunger shown in FIG. 22.
Figure 24:
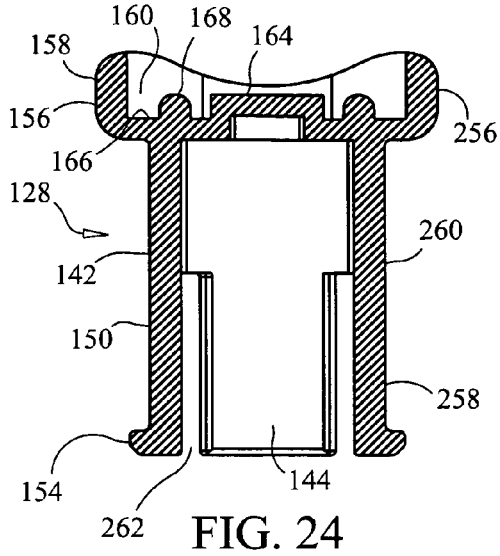
FIG. 24 is a longitudinal cross-sectional view of the finger plunger shown in FIG. 22.
Figure 25:
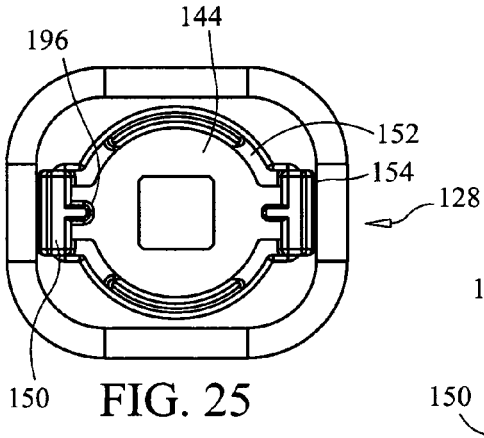
FIG. 25 is a top view of the finger plunger shown in FIG. 22.
Figure 26:
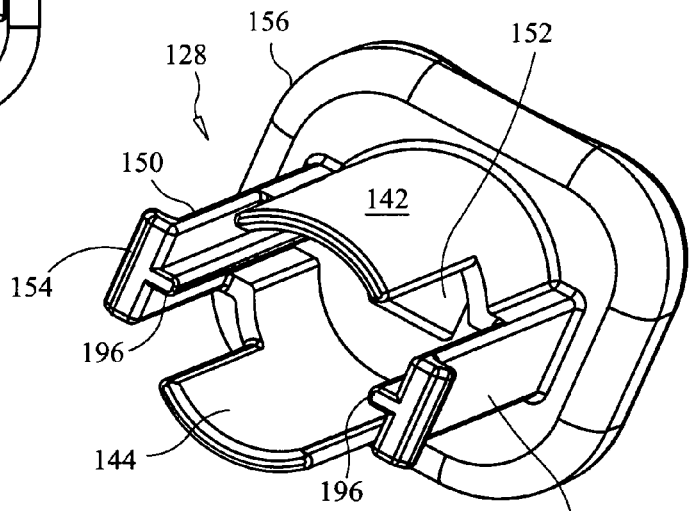
FIG. 26 is a bottom isometric view of the finger plunger shown in FIGS. 22 and 23, taken from a different prospective from that shown in FIG. 23.

FIG. 21 is an isometric view of the palm cushion 180 of the finger and hand exerciser shown in FIG. 12 of the drawings. The palm cushion 180, on its inside surface, includes three parallel recesses 192 for receiving the ribs 182 formed on the callus rib plate 202, when the palm cushion 180 and callus rib plate 202 are mounted on the bottom wall 110 of the housing. Protrusions 194 which extend from the side walls of the palm cushion 180 towards the interior space defined by the palm cushion 180 fill in the void between the side edges of the callus rib plate 202 and the prongs 204, which are slightly recessed inwardly from the edges. The palm cushion 180 preferably includes a flexible and deformable lip 205 situated at the edge of the open side of the cushion and extending radially inwardly therefrom. The palm cushion 180 and lip 205 stretch over the bottom wall 110 and callus rib plate 202, and metronome 184 if such is included, to secure the palm cushion 180 to the housing 102 until it is purposely removed therefrom by the user.

Figure 48:
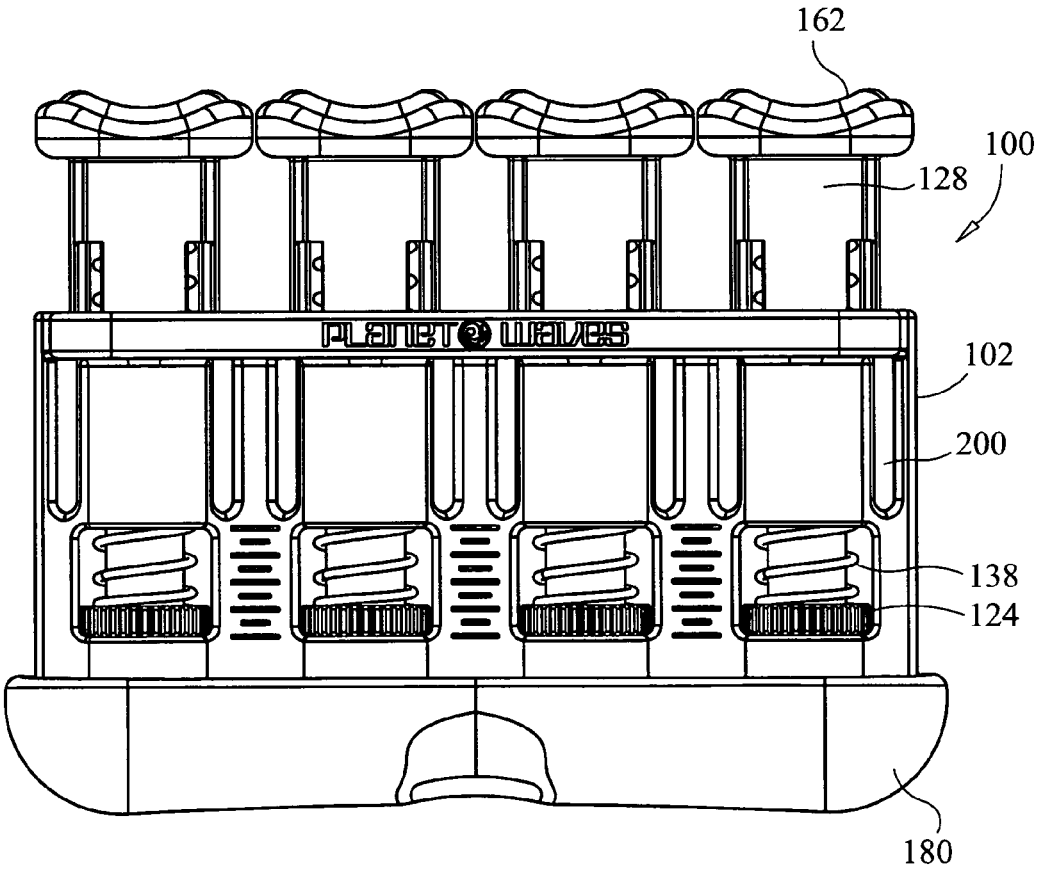
FIG. 48 is a side view of the finger and hand exerciser of the present invention in a preferred form.

FIG. 48 is a side view of the finger and hand exerciser of the present invention in its preferred form. Again, it can be seen from FIG. 48 that the tension adjustment members 130 are situated in their lowest position on housing 102 to provide the least resistance to finger exercise, and the finger plungers 128 are situated in their most extended position on housing 102. Also, it can be clearly seen from FIG. 48 that the palm cushion 180 has a central indentation 220 formed transversely across the central portion thereof. This indentation is provided to allow the user to rest his thumb thereat in a more comfortable position when exercising his thumb and fingers and to prevent or minimize his thumb from slipping off the palm cushion 180 during an exercise regimen.

Figure 49:
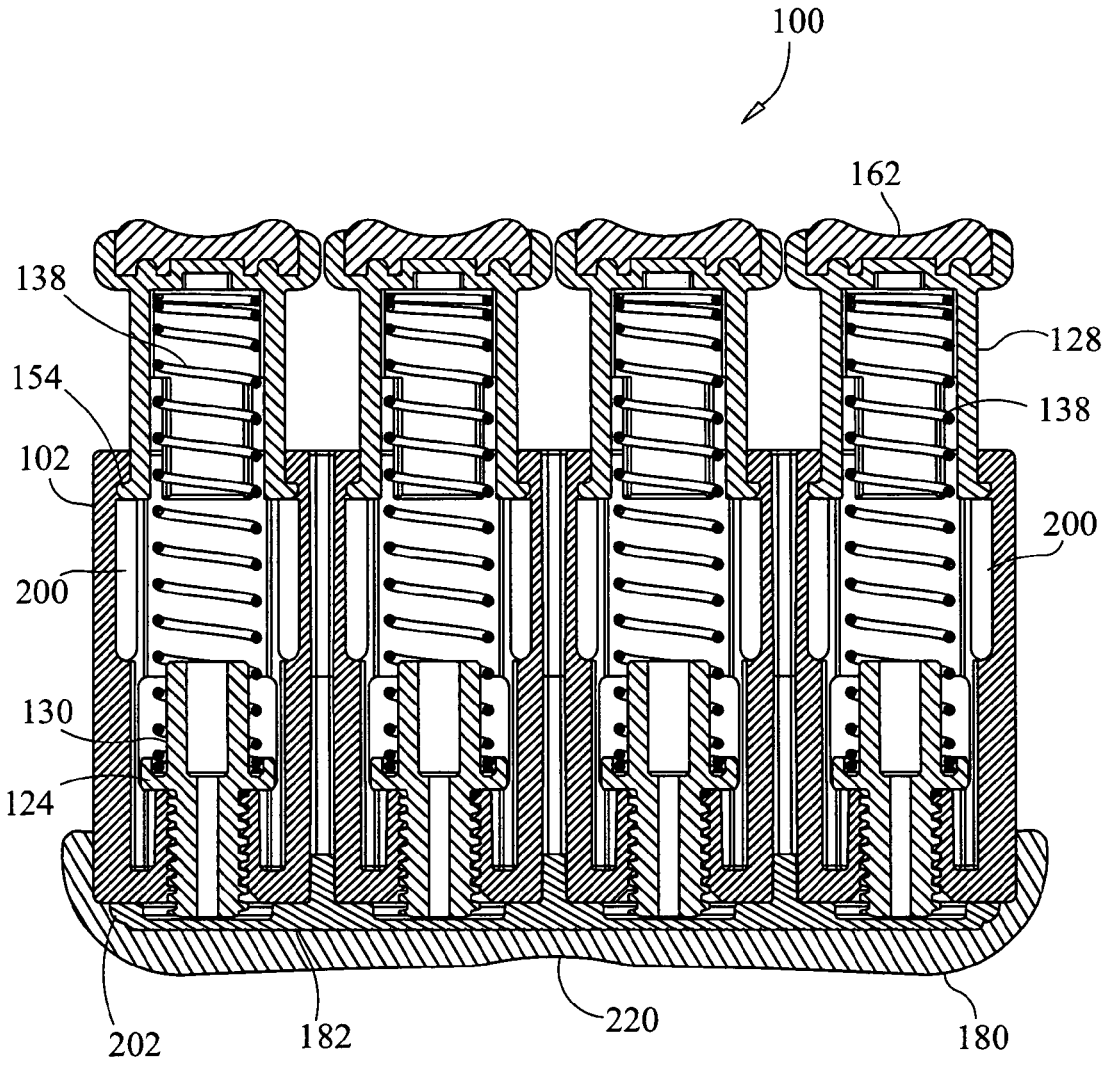
FIG. 49 is a longitudinal cross-sectional view of the finger and hand exerciser of the present invention shown in FIG. 48.

FIG. 49 is a longitudinal cross-sectional view of the finger and hand exerciser of the present invention shown in FIG. 48.

Figure 50:
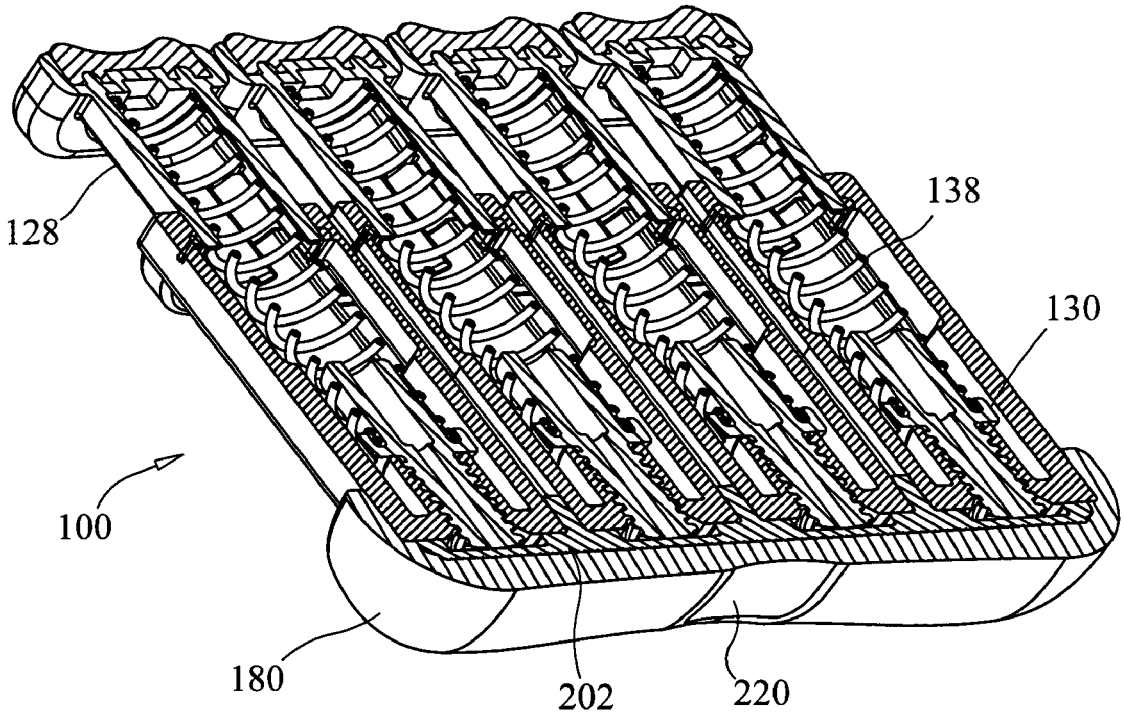
FIG. 50 is an isometric, cross-sectional view of the finger and hand exerciser of the present invention shown in FIG. 48.

FIG. 50 is an isometric, cross-sectional view of the finger and hand exerciser of the present invention shown in FIG. 48.

Figure 51:
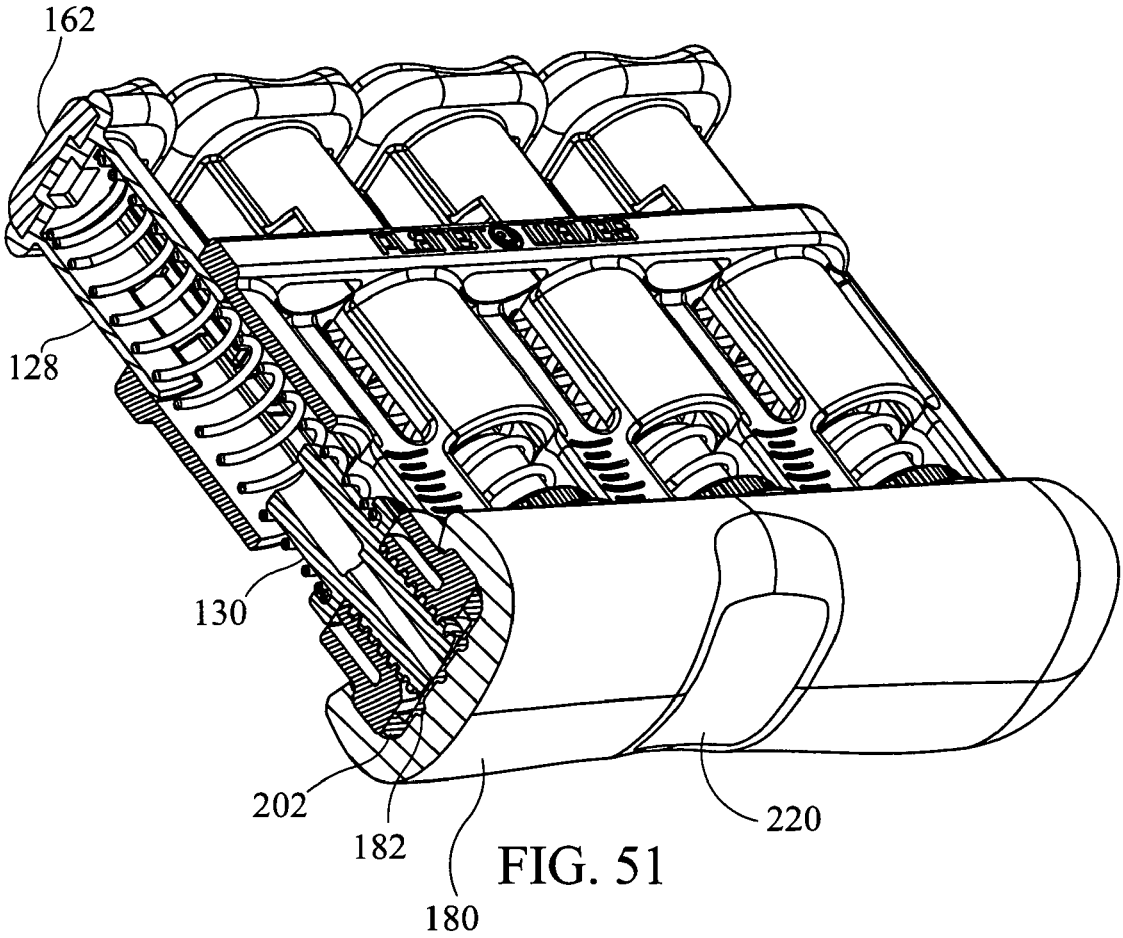
FIG. 51 is an isometric, transverse cross-sectional view of the finger and hand exerciser of the present invention shown in FIG. 48.

FIG. 51 is an isometric, transverse cross-sectional view of the finger and hand exerciser of the present invention shown in FIG. 48.

Figure 52:
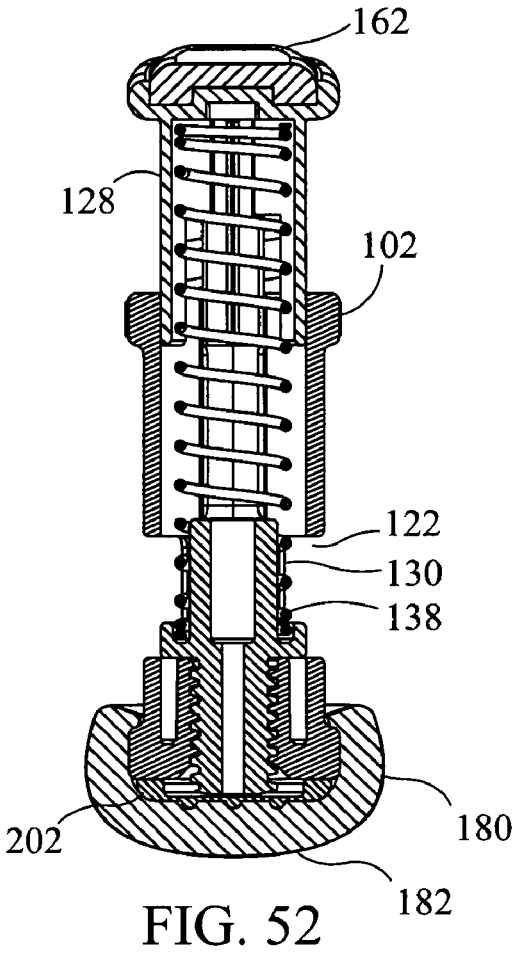
FIG. 52 is a transverse cross-sectional view of the finger and hand exerciser of the present invention in a preferred form.

FIG. 52 is a transverse cross-sectional view of the finger and hand exerciser of the present invention in its preferred form.

Figure 53:
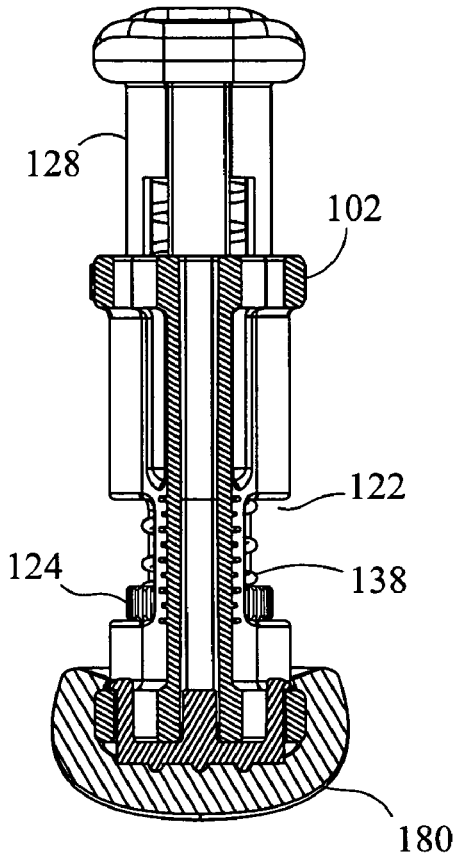
FIG. 53 is yet another transverse cross-sectional view of the finger and hand exerciser of the present invention in a preferred form.

FIG. 53 is yet another transverse cross-sectional view of the finger and hand exerciser of the present invention in its preferred form.

Figure 54:
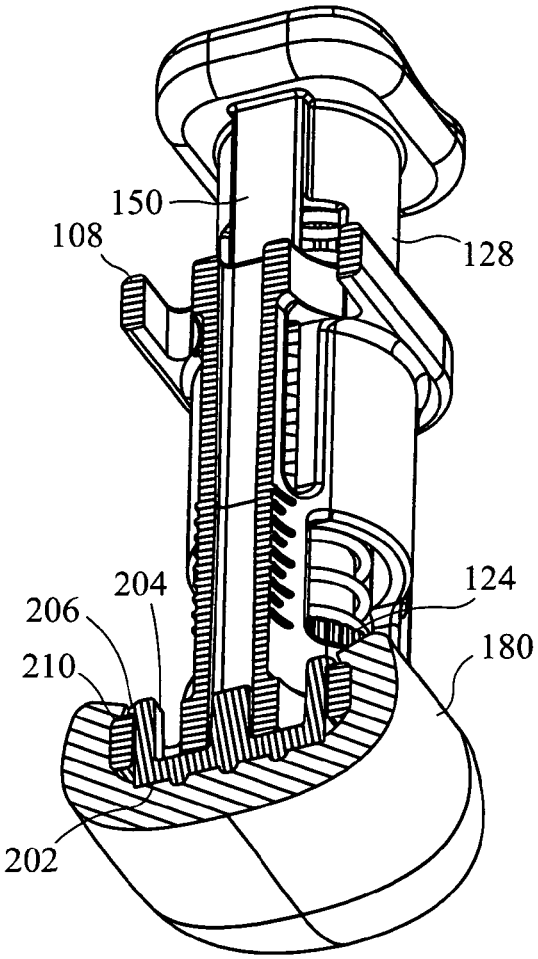
FIG. 54 is an isometric, transverse cross-sectional view of the finger and hand exerciser of the present invention in a preferred form.

FIG. 54 is an isometric, transverse cross-sectional view of the finger and hand exerciser of the present invention in its preferred form.

Figure 55:
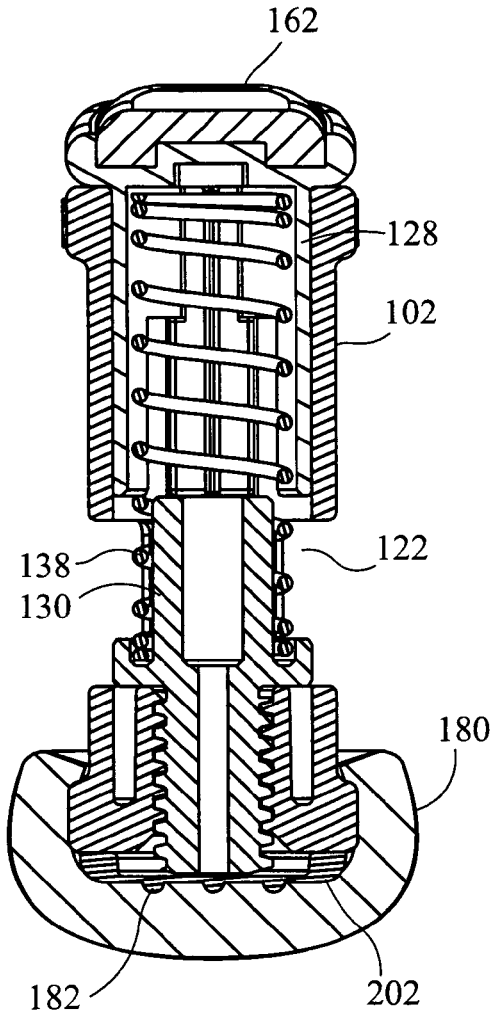
FIG. 55 is yet another transverse cross-sectional view of the finger and hand exerciser of the present invention in a preferred form.

FIG. 55 is yet another transverse cross-sectional view of the finger and hand exerciser of the present invention in its preferred form.

Figure 56:
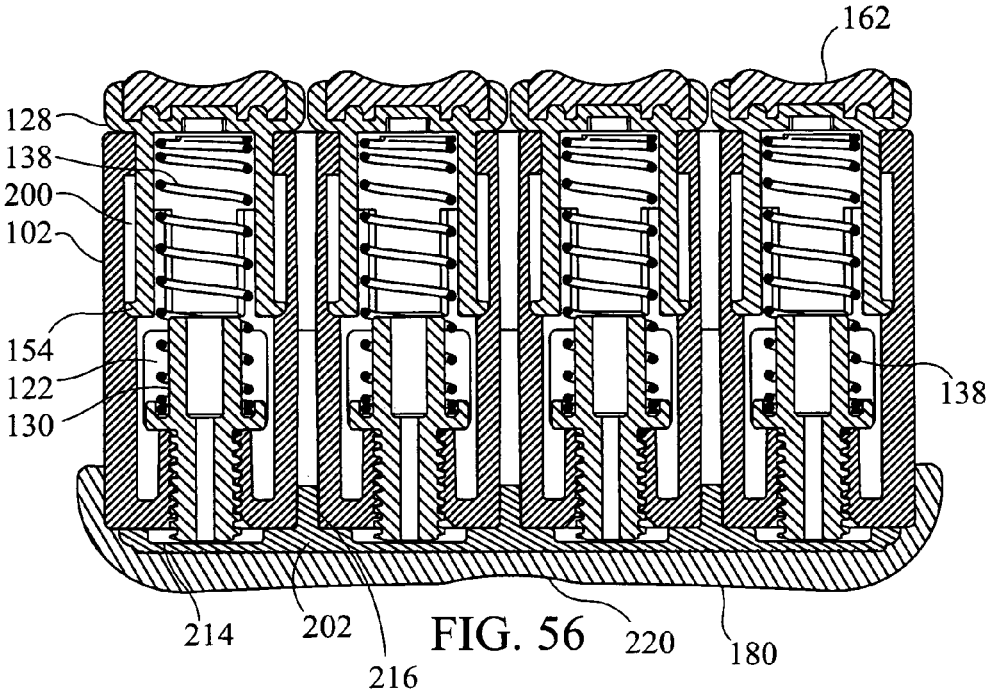
FIG. 56 is a longitudinal cross-sectional view of the finger and hand exerciser of the present invention in a preferred form.

FIG. 56 is a longitudinal cross-sectional view of the finger and hand exerciser of the present invention in its preferred form. Here, the finger and hand exerciser is illustrated with the plungers 128 in a depressed state.

Figure 57:
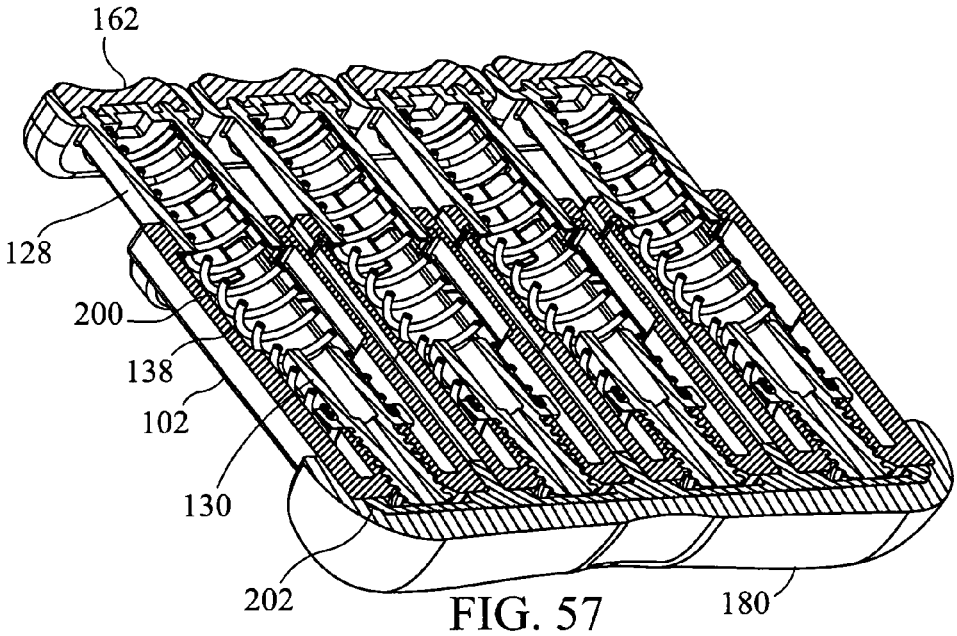
FIG. 57 is another isometric, longitudinal cross-sectional view of the finger and hand exerciser of the present invention in a preferred form.

FIG. 57 is another isometric, longitudinal cross-sectional view of the finger and hand exerciser of the present invention in its preferred form.

Figure 58:
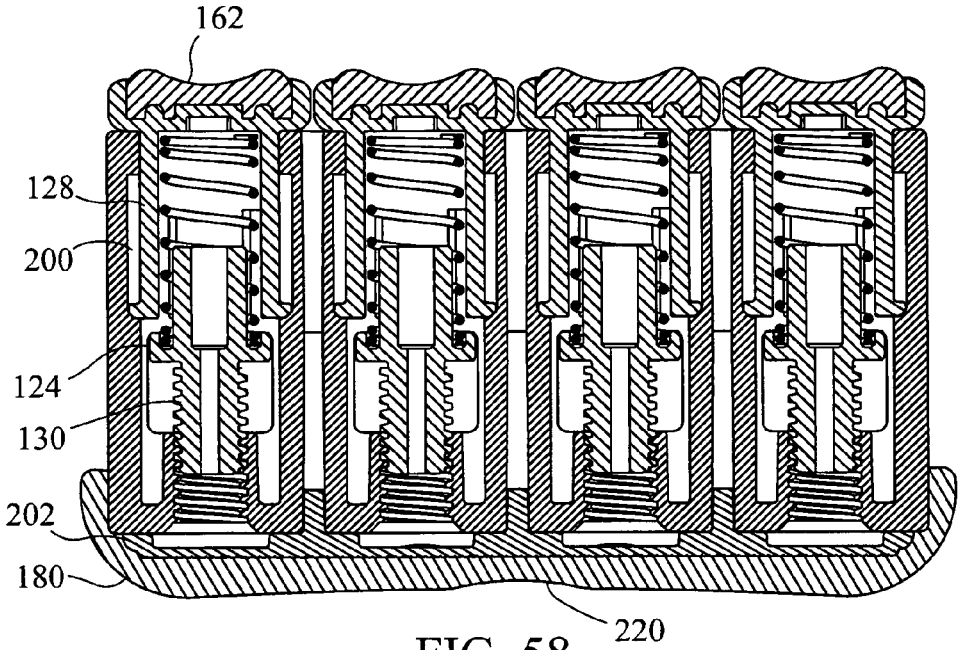
FIG. 58 is a longitudinal cross-sectional view of the finger and hand exerciser of the present invention in a preferred form.
Figure 59:
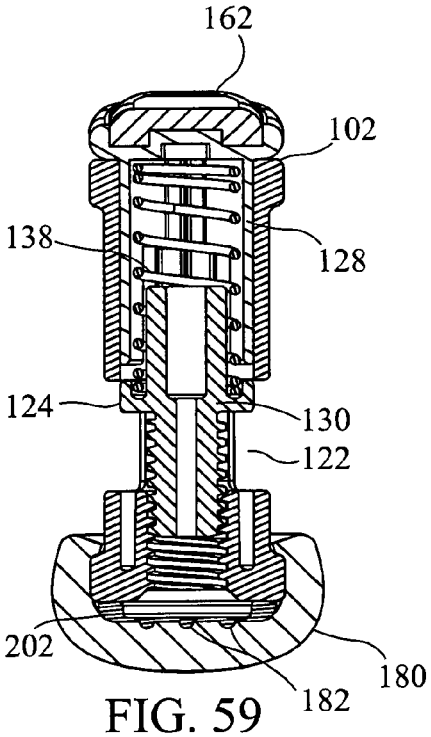
FIG. 59 is a transverse cross-sectional view of the finger and hand exerciser of the present invention shown in FIG. 58.

FIG. 58 is a longitudinal cross-sectional view of the finger and hand exerciser of the present invention in its preferred form. Here, it can be seen that each tension adjustment member 130 is situated in its highest position within housing 102 to provide the greatest tension in compression springs 138 and the most resistance to the user during an exercise regimen. Also, it can be seen from FIG. 58 that each plunger 128 is depressed to its lowest position with respect to housing 102.

FIG. 59 is a transverse cross-sectional view of the finger and hand exerciser of the present invention shown in FIG. 59, again with the tension adjustment member 130 shown in its highest position on housing 102, and the plunger 128 depressed to its lowest position with respect to housing 102.

Figure 60:
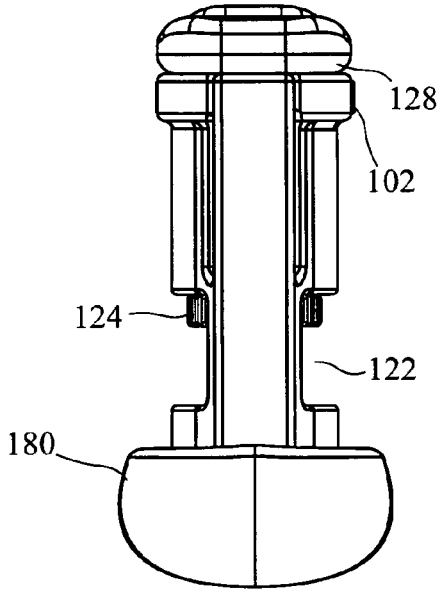
FIG. 60 is an end view of the finger and hand exerciser of the present invention in a preferred form.

FIG. 60 is an end view of the finger and hand exerciser of the present invention in its preferred form, with the tension adjustment members 130 shown in their highest position on housing 102, and the plungers 128 shown fully depressed.

Figure 61:
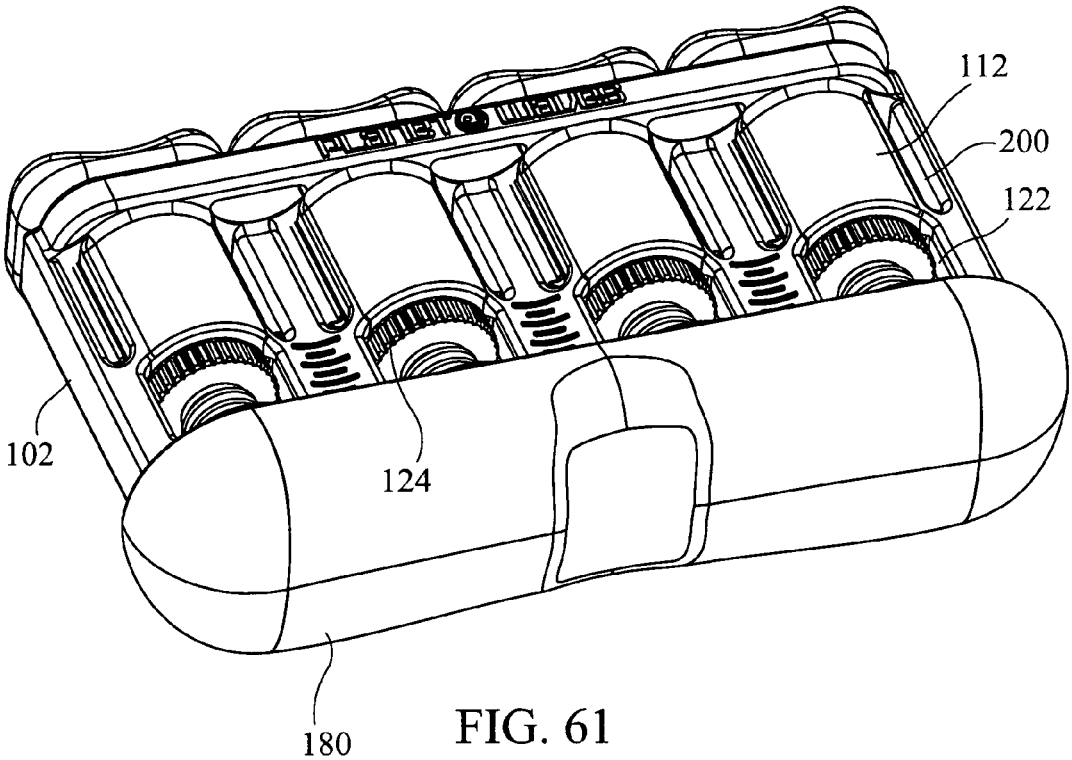
FIG. 61 is a bottom isometric view of the finger and hand exerciser of the present invention in a preferred form.

FIG. 61 is a bottom isometric view of the finger and hand exerciser of the present invention in its preferred form, again with the tension adjustment members 130 shown in their highest position on housing 102, and each finger plunger 128 shown fully depressed.

Figure 62:
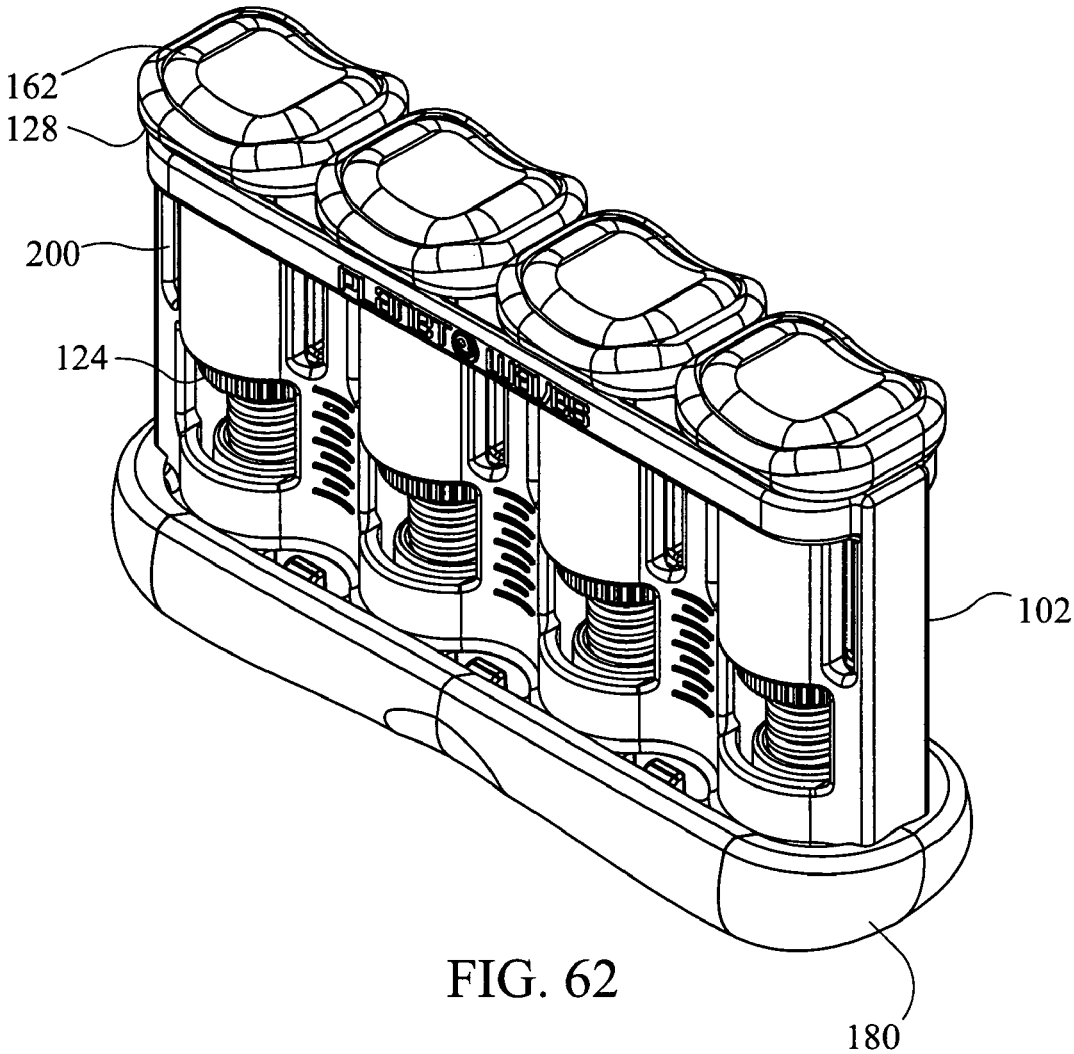
FIG. 62 is a top isometric view of the finger and hand exerciser of the present invention in a preferred form.

FIG. 62 is a top isometric view of the finger and hand exerciser of the present invention in its preferred form, again showing each tension adjustment member 130 in its highest position on housing 102 to provide the greatest resistance for the user, and with each finger plunger 128 being shown in its fully depressed state.

Figure 63:
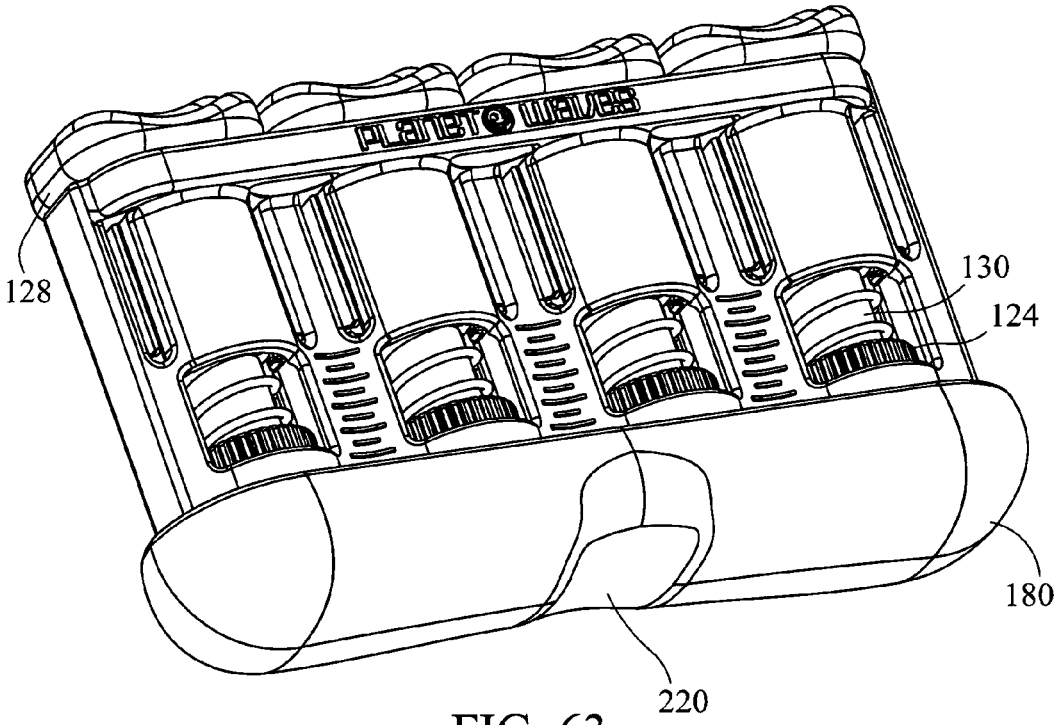
FIG. 63 is a bottom isometric view of the finger and hand exerciser of the present invention in a preferred form.

FIG. 63 is a bottom isometric view of the finger and hand exerciser of the present invention in its preferred form. Here, each tension adjustment member 130 is shown in its lowest position on housing 102 to provide the least resistance for the user, and each finger plunger 128 is shown as being fully depressed on housing 102.

Figure 64:
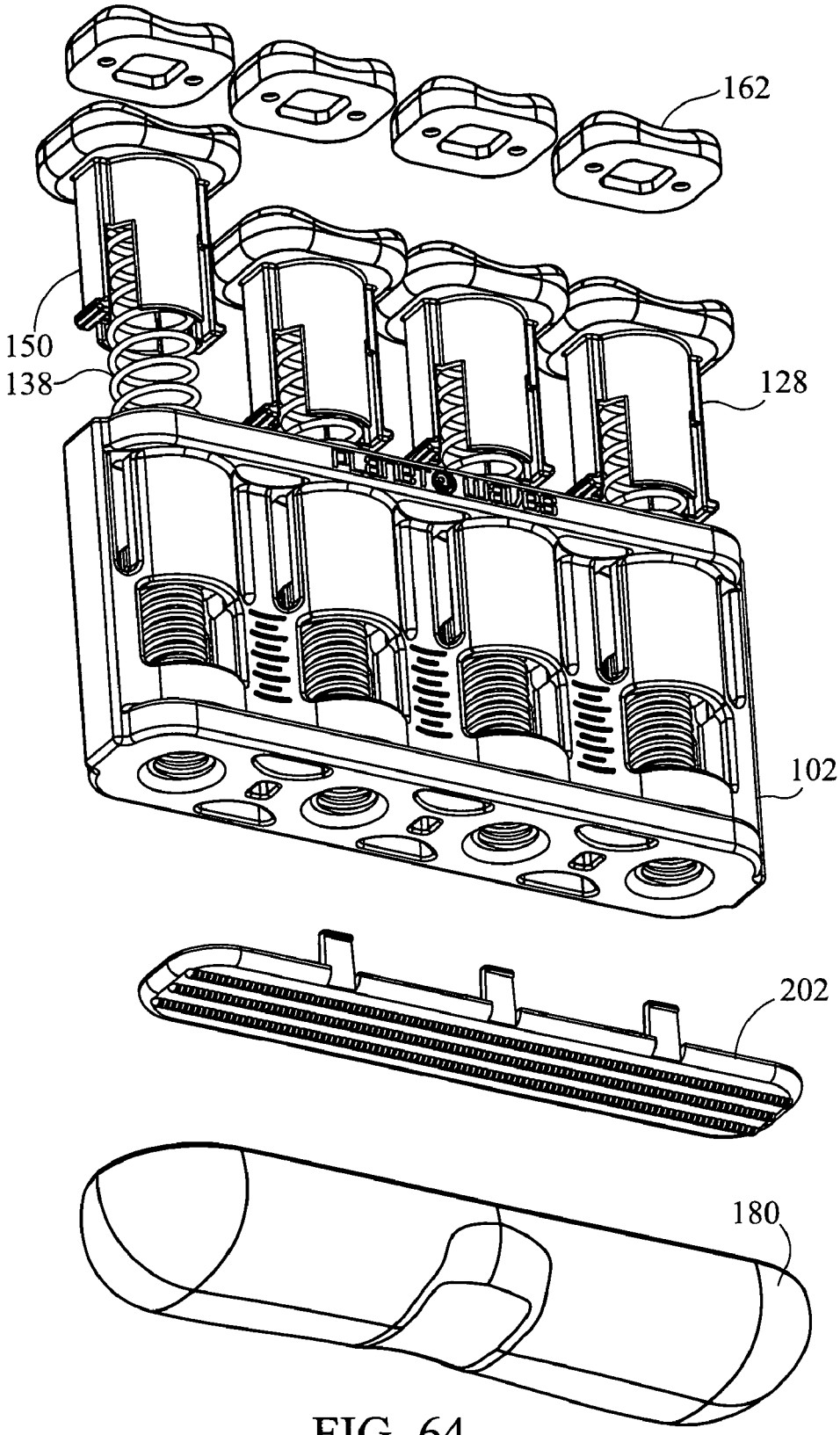
FIG. 64 is a partially exploded, bottom isometric view of the finger and hand exerciser of the present invention in a preferred form.

FIG. 64 is a partially exploded, bottom isometric view of the finger and hand exerciser of the present invention in its preferred form.

Figure 65:
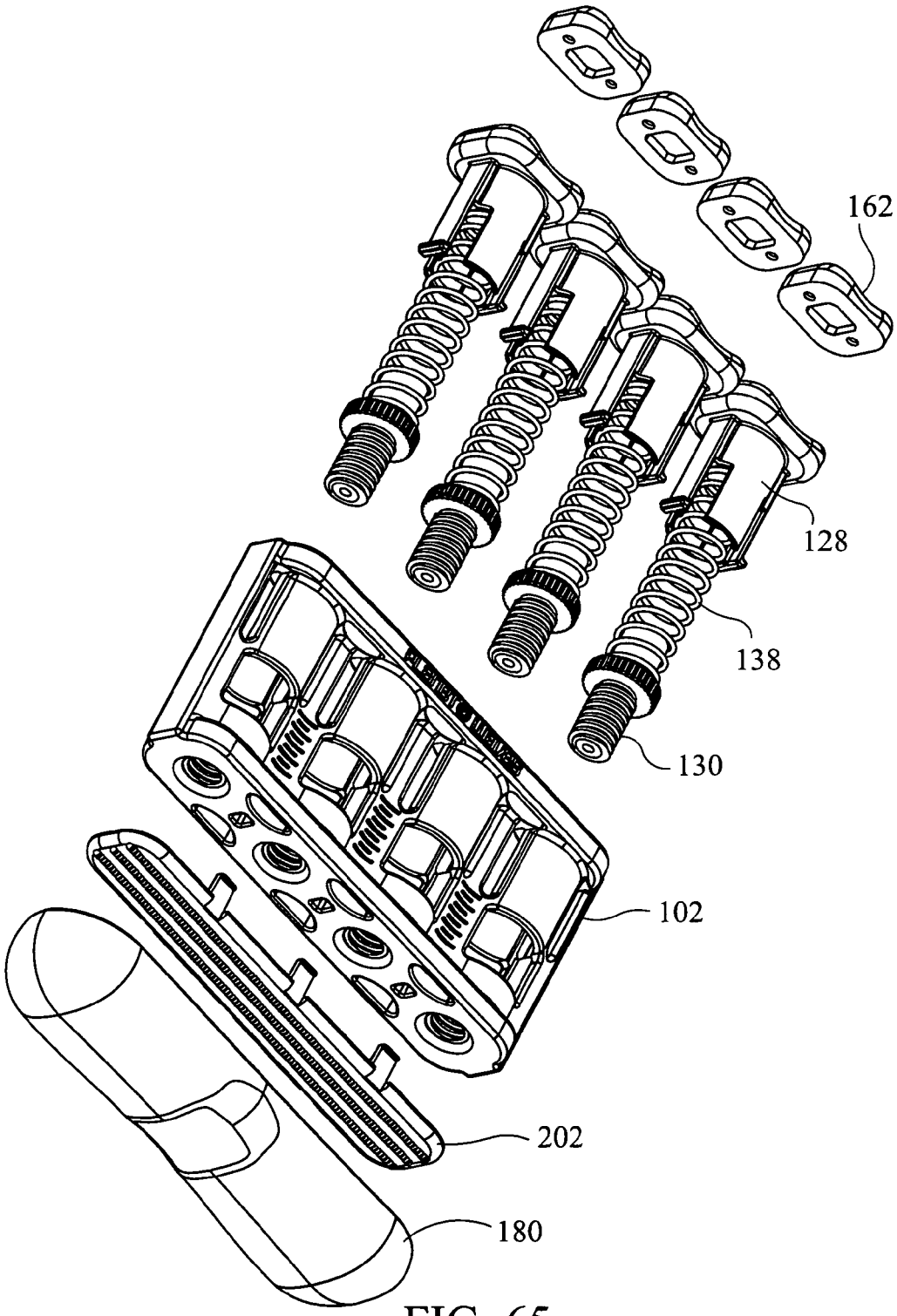
FIG. 65 is another partially exploded, bottom isometric view of the finger and hand exerciser of the present invention in a preferred form.

FIG. 65 is another partially exploded, bottom isometric view of the finger and hand exerciser of the present invention in its preferred form.

Figure 66:
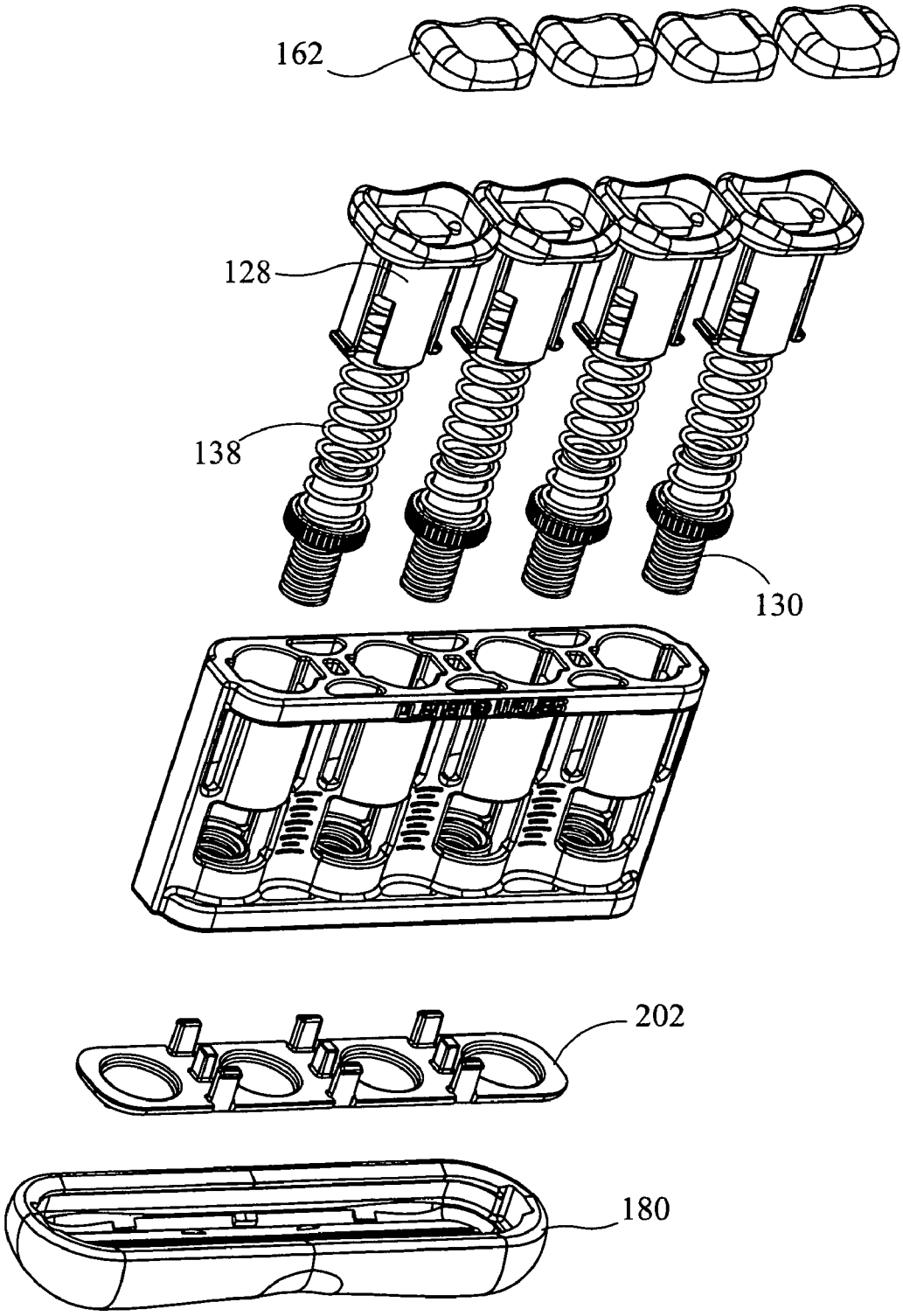
FIG. 66 is a partially exploded, top isometric view of the finger and hand exerciser of the present invention in a preferred form.

FIG. 66 is a partially exploded, top isometric view of the finger and hand exerciser of the present invention in its preferred form.

Figure 67:
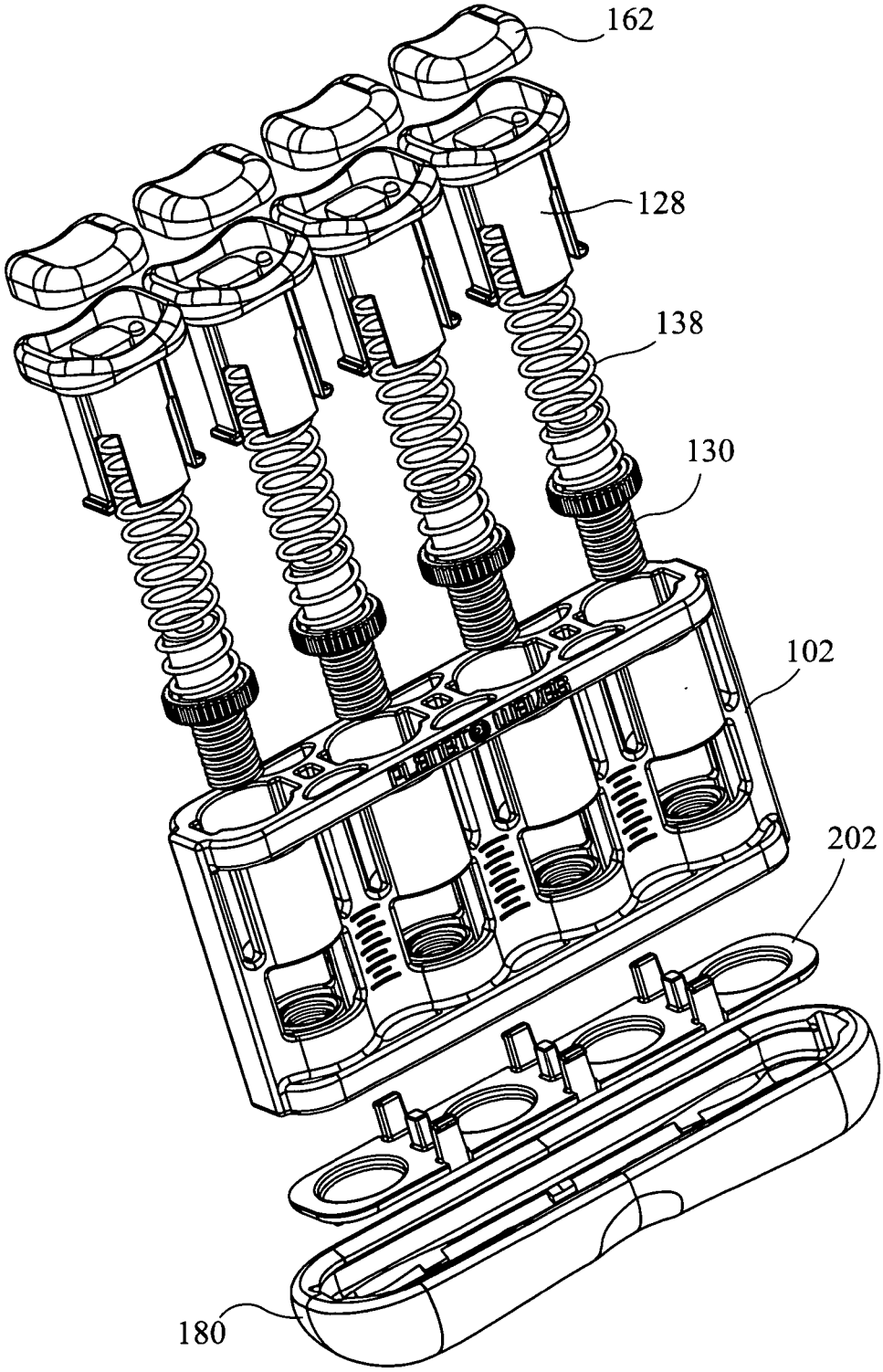
FIG. 67 is another partially exploded, top isometric view of the finger and hand exerciser of the present invention in a preferred form.

FIG. 67 is another partially exploded, top isometric view of the finger and hand exerciser of the present invention in its preferred form, and viewed from a different angle than that shown in FIG. 66.

Figure 68:
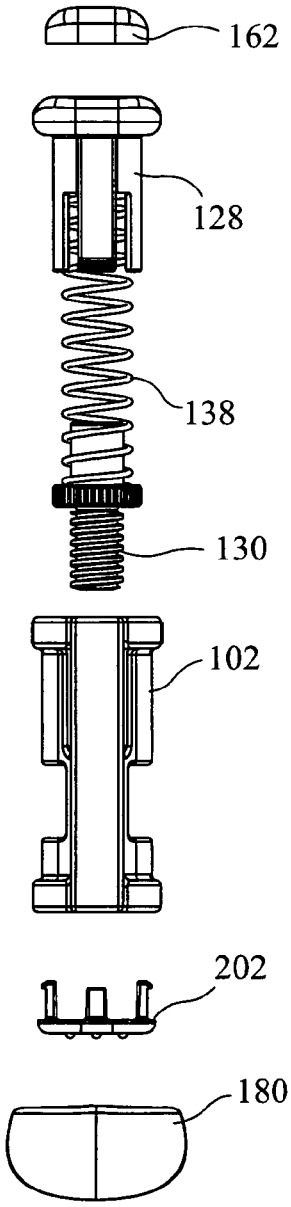
FIG. 68 is a partially exploded, end view of the finger and hand exerciser of the present invention, in a preferred form.

FIG. 68 is a partially exploded, end view of the finger and hand exerciser of the present invention, in its preferred form.

Figure 69:
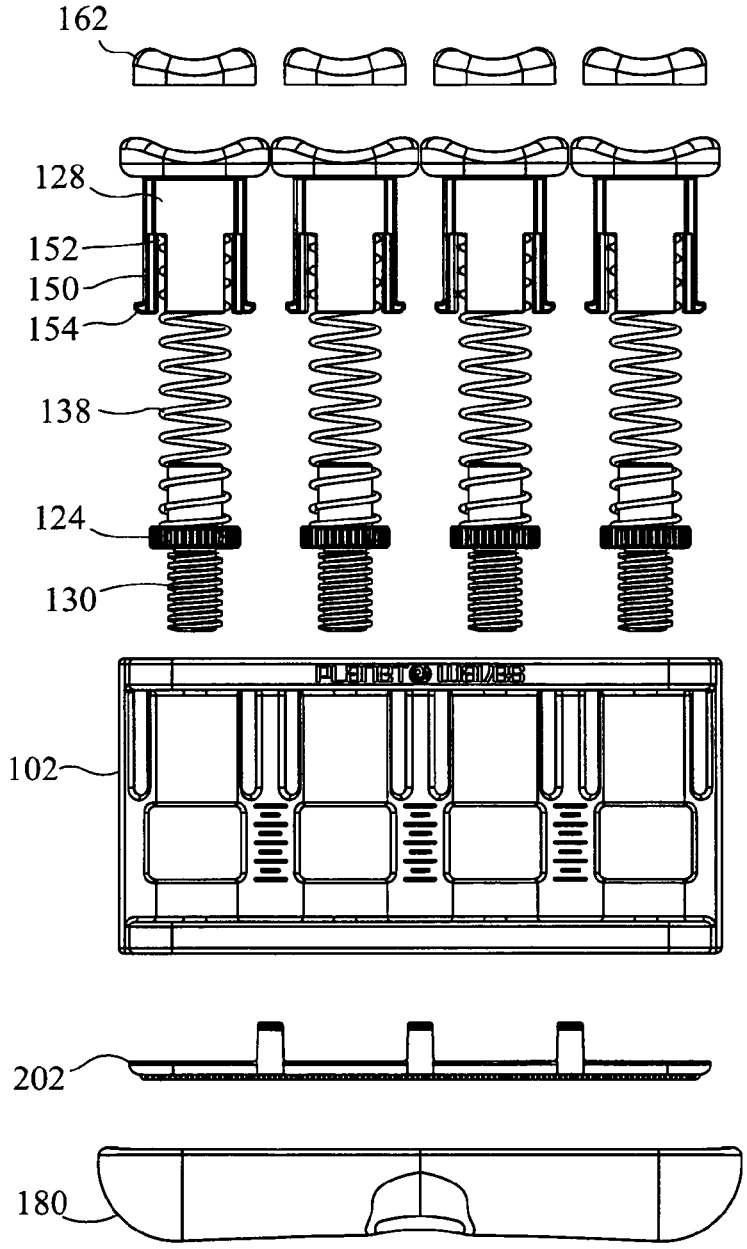
FIG. 69 is a partially exploded, side view of the finger and hand exerciser of the present invention in a preferred form.

FIG. 69 is a partially exploded, side view of the finger and hand exerciser of the present invention in its preferred form.

Figure 70:
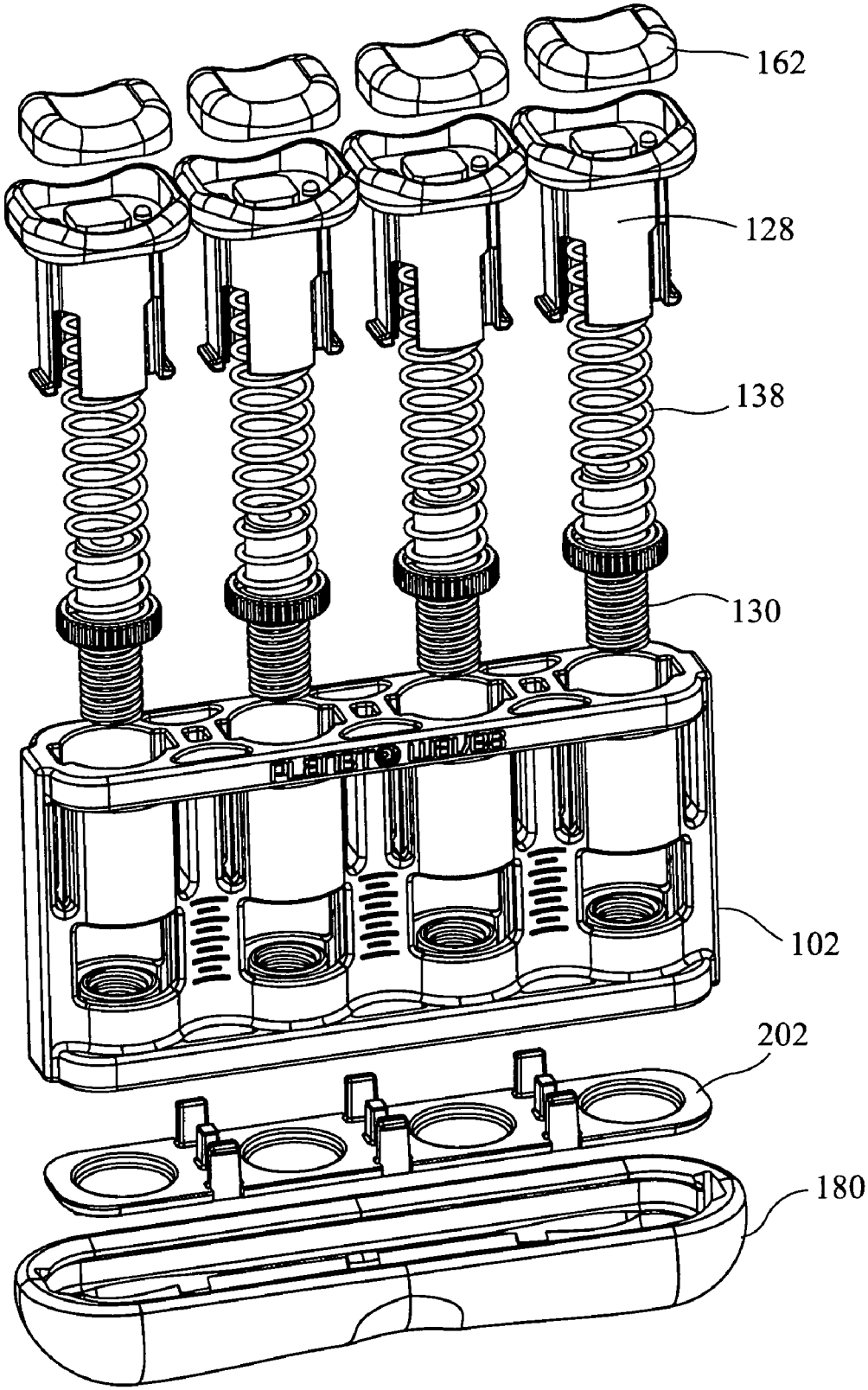
FIG. 70 is a partially exploded, side view of the finger and hand exerciser of the present invention in a preferred form.

FIG. 70 is a partially exploded, side view of the finger and hand exerciser of the present invention in its preferred form.

FIG. 71 is another partially exploded, isometric view of the finger and hand exerciser of the present invention in its preferred form.

As can been seen from the drawings and the foregoing description, a finger and hand exerciser 100 in one form of the present invention includes a housing 102 defining a plurality of chambers 114 arranged side-by-side, a plurality of tension adjustment members 130, each tension adjustment member 130 being received by a corresponding chamber 114, a plurality of plungers 128, each plunger 128 being received by a corresponding chamber 114 and being reciprocatingly axially movable within the corresponding chamber, and a plurality of compression springs 138. Each compression spring 138 is received by a corresponding chamber 114 and is operatively in engagement with a corresponding tension adjustment member 130 and operatively biases a corresponding plunger 128 received by the corresponding chamber 114. Furthermore, each tension adjustment member 130 is axially movable within a corresponding chamber 114 to place a selected amount of tension on the compression spring 138 received by the corresponding chamber. Preferably, each compression spring 138 received by a corresponding chamber 114 is interposed between a respective plunger 128 and a respective tension adjustment member 130 received by the corresponding chamber.

Even more preferably, each tension adjustment member 130 is rotatable within a corresponding chamber 114. The rotation of a respective tension adjustment member 130 causes axial movement of the respective tension adjustment member within the corresponding chamber 114. Each tension adjustment member 130 preferably includes a wheel 124 exposed on the housing 102 for a user of the finger and hand exerciser 100 to contact in order to rotate each tension adjustment member 130, which effects axial movement of the tension adjustment member within a corresponding chamber 114.

In another preferred embodiment of the finger and hand exerciser 100 of the present invention, the housing 102 includes a plurality of threaded bores 118, each threaded bore 118 being co-axial and in communication with a corresponding chamber 114. Each tension adjustment member 130 includes a first axial end portion 132, a second axial end portion 134 situated opposite the first axial end portion 132, and a middle portion 136 interposed between the first axial end portion 132 and the second axial end portion 134. The second axial end portion 134 includes a threaded outer surface, the threaded outer surface of the second axial end portion 134 of each tension adjustment member 130 being in threading engagement with a corresponding threaded bore 118.

Furthermore, each compression spring 138 preferably is an elongated member in the form of a helical coil and includes a first axial end portion 250 and a second axial end portion 252 situated opposite the first axial end portion 250, and defines a bore 254 extending axially between the first axial end portion 250 and the second axial end portion 252. The first axial end portion 132 of each tension adjustment member 130 preferably overlaps the second axial end portion 252 of a corresponding compression spring 138 in order to help prevent the corresponding compression spring 138 from deflecting in a radial direction when the corresponding compression spring is compressed. Even more preferably in this regard, the first axial end portion 132 of each tension adjustment member 130 is received by the bore 254 of a corresponding compression spring 138 at the second axial end portion 252 of the corresponding compression spring.

In accordance with another preferred embodiment of the present invention, the middle portion 136 of each tension adjustment member 130 defines a cup or well 140 for receiving the second axial end portion 252 of a corresponding compression spring 138.

A finger and hand exerciser 100 constructed in accordance with another form of the present invention includes plungers 128 in which each plunger 128 has a first axial end portion 256, a second axial end portion 258 situated opposite the first axial end portion 256, and a middle portion 260 interposed between the first axial end portion 256 and the second axial end portion 258. The second axial end portion 258 of each plunger 128 has an open end 262, and the middle portion 260 of each plunger 128 defines a bore 144 extending axially between the first axial end portion 256 of a respective plunger and the second axial end portion 258 of a respective plunger, the bore 144 being in communication with the open end 262 of the second axial end portion 258 of the respective plunger 128. The bore 144 of each plunger 128 preferably receives the first axial end portion 250 of a corresponding compression spring 138.

In another preferred form of the finger and hand exerciser 100 of the present invention, the housing 102 has formed therein a plurality of slots 126. Each slot 126 is in communication with a corresponding chamber 114. Additionally, the second axial end portion 258 of each plunger 128 includes at least one resilient tab 150, the resilient tab 150 being received by a corresponding slot 126 to cause each plunger 128 to be captively received by and reciprocatingly slidable in a corresponding chamber 114.

Preferably, the first axial end portion 256 of each plunger 128 extends axially outwardly from a corresponding chamber 114 for engagement by a user of the finger and hand exerciser 100, and the first axial end portion 256 of each plunger 128 has mounted thereon a finger cushion 162. Even more preferably in this regard, the finger cushion 162 mounted on the first axial end portion 256 of each plunger 128 has a concave surface for receiving a finger of the user of the finger and hand exerciser 100.

In accordance with another preferred form of the present invention, the housing 102 of the finger and hand exerciser 100 has a top side 108 and a bottom side 110 situated opposite the top side 108, and a front side 104 and a rear side 106 situated opposite the front side 104. Furthermore, portions of the plungers 128 extend at least partially from the housing 102 on the top side 108 thereof.

Additionally, the finger and hand exerciser 100 of the present invention preferably includes a removable palm cushion 180. The removable palm cushion 180 is mounted on the bottom side 110 of the housing 102 and is removable therefrom. The removable palm cushion 180 is dimensioned to fit over the portions of the plungers 128 which extend at least partially from the housing 102 on the top side 108 thereof.

In another embodiment of the finger and hand exerciser 100 of the present invention, the bottom side 110 of the housing includes at least one elongated rib 182 extending outwardly from the surface thereof to simulate a musical instrument string. Even more preferably, the finger and hand exerciser 100 further includes a removable plate 202, the removable plate 202 having a first surface 266 and a second surface 268 situated opposite the first surface 266. The second surface 268 has at least one elongated rib 182 extending outwardly therefrom to simulate a musical instrument string. The removable plate 202 is removably mounted at the first surface 266 thereof on the bottom side 110 of the housing 102.

In yet another embodiment of the finger and hand exerciser 100, the housing 102 includes a plurality of cutouts 122 formed in at least one of the front side 104 and the rear side 106. Each cutout 122 is in alignment and communication with a corresponding chamber 114 to expose a portion (e.g., the wheel 124) of the tension adjustment member 130 received by the corresponding chamber 114 and to allow a user of the finger and hand exerciser 100 to contact the portion (e.g., the wheel 124) of the tension adjustment member 130 exposed through the cutout 122 to cause the tension adjustment member 130 to move axially within the corresponding chamber 114.

Also, in a preferred form of the present invention, the housing 102 further includes a plurality of markings 178. The markings 178 are disposed on at least one of the front side 104 and the rear side 106 of the housing 102. At least one of the markings 178 is situated in proximity to a corresponding cutout 122 and the portion (e.g., wheel 124) of the tension adjustment member 130 exposed through the corresponding cutout 122. The markings 178 provide an indication of the relative tension placed on a compression spring 138 by a corresponding tension adjustment member.

In still another embodiment, the finger and hand exerciser 100 includes a metronome 184, the metronome 184 being mounted on the bottom side 110 of the housing 102.

The finger and hand exerciser of the present invention allows the user to adjust the resistance provided by the exerciser applied individually to each finger of the user. More specifically, the finger and hand exerciser of the present invention allows the user to adjust the individual spring tension in each finger plunger without affecting the height of the finger plungers relative to the base or housing of the exerciser on which they are mounted. Indicia situated on the front and rear sides of the housing of the finger and hand exerciser provides an indication of the relative resistance provided by the exerciser for each finger of the user.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A finger and hand exerciser, which comprises:

a housing defining a plurality of chambers arranged side-by-side;

a plurality of tension adjustment members, each tension adjustment member being received by a corresponding one of said chambers;

a plurality of plungers, each plunger being received by a corresponding one of said chambers and being reciprocatingly axially movable within the corresponding chamber; and a plurality of compression springs, each compression spring being received by a corresponding chamber and being operatively in engagement with a corresponding tension adjustment member and operatively biasing a corresponding plunger received by the corresponding chamber, each tension adjustment member being axially movable within a corresponding chamber to place a selected amount of tension on the compression spring received by the corresponding chamber;

wherein each tension adjustment member is rotatable within a corresponding chamber and rotation of a respective tension adjustment member causes axial movement of the respective tension adjustment member within the corresponding chamber; and wherein each tension adjustment member includes a wheel exposed on the housing for a user of the finger and hand exerciser to contact to rotate each tension adjustment member and to effect axial movement of the tension adjustment member within a corresponding chamber.

2. A finger and hand exerciser as defined by claim 1, wherein the housing includes a plurality of threaded bores, each threaded bore being co-axial and in communication with a corresponding chamber; wherein each tension adjustment member includes a first axial end portion, a second axial end portion situated opposite the first axial end portion, and a middle portion interposed between the first axial end portion and the second axial end portion; and wherein the second axial end portion includes a threaded outer surface, the threaded outer surface of the second axial end portion of each tension adjustment member being in threading engagement with a corresponding threaded bore.

3. A finger and hand exerciser, which comprises:

a housing defining a plurality of chambers arranged side-by-side;

a plurality of tension adjustment members, each tension adjustment member being received by a corresponding one of said chambers;

a plurality of plungers, each plunger being received by a corresponding one of said chambers and being reciprocatingly axially movable within the corresponding chamber; and a plurality of compression springs, each compression spring being received by a corresponding one of said chambers and being operatively in engagement with a corresponding tension adjustment member and operatively biasing a corresponding plunger received by the corresponding chamber, each tension adjustment member being axially movable within a corresponding chamber to place a selected amount of tension on the compression spring received by the corresponding chamber;

wherein each tension adjustment member includes a first axial end portion, a second axial end portion situated opposite the first axial end portion, and a middle portion interposed between the first axial end portion and the second axial end portion; and wherein each compression spring is an elongated member and includes a first axial end portion and a second axial end portion situated opposite the first axial end portion, and defines a bore extending axially between the first axial end portion and the second axial end portion; and wherein the first axial end portion of each tension adjustment member overlaps the second axial end portion of a corresponding compression spring in order to help prevent the corresponding compression spring from deflecting in a radial direction when the corresponding compression spring is compressed.

4. A finger and hand exerciser as defined by claim 3, wherein the first axial end portion of each tension adjustment member is received by the bore of a corresponding compression spring at the second axial end portion of the corresponding compression spring.

5. A finger and hand exerciser as defined by claim 4, wherein the middle portion of each tension adjustment member defines a well for receiving the second axial end portion of a corresponding compression spring.

6. A finger and hand exerciser as defined by claim 3, wherein each plunger has a first axial end portion, a second axial end portion situated opposite the first axial end portion, and a middle portion interposed between the first axial end portion and the second axial end portion, the second axial end portion of each plunger having an open end, the middle portion of each plunger defining a bore extending axially between the first axial end portion of a respective plunger and the second axial end portion of a respective plunger and being in communication with the open end of the second axial end portion of the respective plunger, the bore of each plunger receiving the first axial end portion of a corresponding compression spring.

7. A finger and hand exerciser as defined by claim 6, wherein the housing has formed therein a plurality of slots, each slot being in communication with a corresponding chamber; and wherein the second axial end portion of each plunger includes at least one resilient tab, the resilient tab being received by a corresponding slot to cause each plunger to be captively received by and reciprocatingly slidable in a corresponding chamber.

8. A finger and hand exerciser as defined by claim 6, wherein the first axial end portion of each plunger extends axially outwardly from a corresponding chamber for engagement by a user of the finger and hand exerciser, the first axial end portion of each plunger having mounted thereon a finger cushion.

9. A finger and hand exerciser as defined by claim 8, wherein the finger cushion mounted on the first axial end portion of each plunger has a concave surface for receiving a finger of the user of the finger and hand exerciser.

10. A finger and hand exerciser, which comprises:

a housing defining a plurality of chambers arranged side-by-side; a plurality of tension adjustment members, each tension adjustment member being received by a corresponding one of said chambers;

a plurality of plungers, each plunger being received by a corresponding one of said chambers and being reciprocatingly axially movable within the corresponding chamber; and a plurality of compression springs, each compression spring being received by a corresponding one of said chambers and being operatively in engagement with a corresponding tension adjustment member and operatively biasing a corresponding plunger received by the corresponding chamber, each tension adjustment member being axially movable within a corresponding chamber to place a selected amount of tension on the compression spring received by the corresponding chamber;

wherein the housing has a top side and a bottom side situated opposite the top side, and a front side and a rear side situated opposite the front side; and wherein portions of the plungers extend at least partially from the housing on the top side thereof; and a removable plate, the removable plate having a first surface and a second surface situated opposite the first surface, the second surface having at least one elongated rib extending outwardly therefrom to simulate a musical instrument string, the removable plate being removably mounted at the first surface thereof on the bottom side of the housing.

11. A finger and hand exerciser as defined by claim 10, wherein the bottom side of the housing includes at least one elongated rib extending outwardly from the surface thereof to simulate a musical instrument string.

12. A finger and hand exerciser as defined by claim 10, which further comprises:

a removable palm cushion, the removable palm cushion being mounted on the bottom side of the housing and being removable therefrom, the removable palm cushion being dimensioned to fit over the portions of the plungers which extend at least partially from the housing on the top side thereof.

13. A finger and hand exerciser as defined by claim 10, wherein the housing includes a plurality of cutouts formed in at least one of the front side and the rear side, each cutout being in alignment and communication with a corresponding chamber to expose a portion of the tension adjustment member received by the corresponding chamber and to allow a user of the finger and hand exerciser to contact the portion of the tension adjustment member exposed through the cutout to cause the tension adjustment member to move axially within the corresponding chamber.

14. A finger and hand exerciser as defined by claim 13, wherein the housing further includes a plurality of markings, the markings being disposed on at least one of the front side and the rear side of the housing, at least one of the markings being situated in proximity to a corresponding cutout and the portion of the tension adjustment member exposed through the corresponding cutout, the markings providing an indication of the relative tension placed on a compression spring by a corresponding tension adjustment member.

15. A finger and hand exerciser as defined by claim 10, which further comprises: a metronome, the metronome being mounted on the bottom side of the housing.

16. A finger and hand exerciser as defined by claim 1, wherein each compression spring received by a corresponding chamber is interposed between a respective plunger and a respective tension adjustment member received by the corresponding chamber.

17. A finger and hand exerciser as defined by claim 3, wherein each compression spring received by a corresponding chamber is interposed between a respective plunger and a respective tension adjustment member received by the corresponding chamber.

* * * * *